US010933630B2

(12) United States Patent
Nitta et al.

(10) Patent No.: US 10,933,630 B2
(45) Date of Patent: Mar. 2, 2021

(54) LIQUID EJECTION DEVICE AND MULTI-NOZZLE LIQUID EJECTION DEVICE

(71) Applicant: TOSHIBA TEC KABUSHIKI KAISHA, Tokyo (JP)

(72) Inventors: Noboru Nitta, Tagata Shizuoka (JP); Shunichi Ono, Izu Shizuoka (JP); Sota Harada, Mishima Shizuoka (JP)

(73) Assignee: TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 16/547,616

(22) Filed: Aug. 22, 2019

(65) Prior Publication Data

US 2020/0070506 A1 Mar. 5, 2020

(30) Foreign Application Priority Data

Aug. 28, 2018 (JP) ..... JP2018-159766

(51) Int. Cl.
*B41J 2/045* (2006.01)
*B41J 2/03* (2006.01)

(52) U.S. Cl.
CPC ..... *B41J 2/04525* (2013.01); *B41J 2/03* (2013.01); *B41J 2/04546* (2013.01); *B41J 2/04588* (2013.01)

(58) Field of Classification Search
CPC ..... B41J 2/04525; B41J 2/03; B41J 2/04546; B41J 2/04588; B41J 2/04573; B41J 2/04595; B41J 2/04541; B41J 2/04581; B41J 2002/14459; B41J 2/14; B41J 29/38
USPC ..... 347/10
See application file for complete search history.

(56) References Cited

U.S. PATENT DOCUMENTS 8,567,886 B2 10/2013 Yamaguchi et al.
2006/0044337 A1* 3/2006 Takata ..... B41J 2/0457 347/14
2006/0092196 A1 5/2006 Iwao et al.
2012/0281047 A1 11/2012 Barbet
2016/0075132 A1 3/2016 Kitaoka et al.
(Continued)

FOREIGN PATENT DOCUMENTS

JP 2008-136928 6/2008
JP 2013-091215 5/2013

OTHER PUBLICATIONS

Extended European Search Report for European Patent Application No. 19193118.7 dated Jan. 24, 2020.

*Primary Examiner* — Huan H Tran
*Assistant Examiner* — Alexander D Shenderov
(74) *Attorney, Agent, or Firm* — Amin, Turocy & Watson LLP

(57) ABSTRACT

According to one embodiment, a liquid ejection device includes a nozzle plate, an actuator, a liquid supply unit, a waveform generation circuit, a waveform allocation circuit, and a drive signal output circuit. A plurality of nozzles for ejecting liquid is arranged in the nozzle plate. The actuator is provided in each of the nozzles. The waveform generation circuit generates plural kinds of drive waveforms with different generation start timings. The waveform allocation circuit can set the drive waveform among plural kinds of drive waveforms and the actuator of the nozzle to be allocated. The drive signal output circuit drives the actuator with the allocated drive waveform.

20 Claims, 21 Drawing Sheets

(56) References Cited

U.S. PATENT DOCUMENTS

| | | | |
|---|---|---|---|
| 2018/0037023 | A1 | 2/2018 | Kusunoki et al. |
| 2018/0072056 | A1 | 3/2018 | Nitta et al. |

* cited by examiner

FIG. 9A
CHANNEL NUMBER
| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 1 | 9 | 17 | 25 | 33 | 41 | 49 | 57 | 65 | 73 | 81 | 89 | 97 | 105 | 113 | 121 | 129 | 137 | 145 | 153 | 161 | 169 | 177 | 185 | 193 | 201 | 209 | |
| | 8 | 16 | 24 | 32 | 40 | 48 | 56 | 64 | 72 | 80 | 88 | 96 | 104 | 112 | 120 | 128 | 136 | 144 | 152 | 160 | 168 | 176 | 184 | 192 | 200 | 208 | |
| | 7 | 15 | 23 | 31 | 39 | 47 | 55 | 63 | 71 | 79 | 87 | 95 | 103 | 111 | 119 | 127 | 135 | 143 | 151 | 159 | 167 | 175 | 183 | 191 | 199 | 207 | |
| | 6 | 14 | 22 | 30 | 38 | 46 | 54 | 62 | 70 | 78 | 86 | 94 | 102 | 110 | 118 | 126 | 134 | 142 | 150 | 158 | 166 | 174 | 182 | 190 | 198 | 206 | |
| | 5 | 13 | 21 | 29 | 37 | 45 | 53 | 61 | 69 | 77 | 85 | 93 | 101 | 109 | 117 | 125 | 133 | 141 | 149 | 157 | 165 | 173 | 181 | 189 | 197 | 205 | 213 |
| | 4 | 12 | 20 | 28 | 36 | 44 | 52 | 60 | 68 | 76 | 84 | 92 | 100 | 108 | 116 | 124 | 132 | 140 | 148 | 156 | 164 | 172 | 180 | 188 | 196 | 204 | 212 |
| | 3 | 11 | 19 | 27 | 35 | 43 | 51 | 59 | 67 | 75 | 83 | 91 | 99 | 107 | 115 | 123 | 131 | 139 | 147 | 155 | 163 | 171 | 179 | 187 | 195 | 203 | 211 |
| | 2 | 10 | 18 | 26 | 34 | 42 | 50 | 58 | 66 | 74 | 82 | 90 | 98 | 106 | 114 | 122 | 130 | 138 | 146 | 154 | 162 | 170 | 178 | 186 | 194 | 202 | 210 |
X
Y
FIG. 9B
VOLTAGE VALUE (mV) INDICATING MAGNITUDE OF PRESSURE
| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 5.1 | 6 | 8.3 | 12 | 13 | 15 | 17 | 14 | 12 | 10 | 6.1 | 2.8 | 1.7 | 1.3 | 1.6 | 1.8 | 3.1 | 3.9 | 11 | 12 | 14 | 14 | 11 | 10 | 8.3 | 4.6 | 2.4 | |
| | 5.4 | 6.3 | 9.6 | 11 | 15 | 15 | 14 | 11 | 6.3 | 3.3 | 0.7 | -3 | -2 | 0.1 | -2 | -0 | 1.5 | 7 | 10 | 13 | 14 | 13 | 9.3 | 6.4 | 2.7 | 0.8 | |
| | 5.1 | 5.5 | 8 | 10 | 12 | 13 | 12 | 9.1 | 3.8 | 0.3 | -1 | -1 | 7.2 | 7.7 | 1.5 | -4 | -1 | 1.2 | 8.8 | 11 | 12 | 11 | 8.7 | 6.4 | 1.8 | 0.9 | |
| | 4.2 | 5.8 | 7.4 | 9.7 | 10 | 12 | 10 | 6.8 | 1 | -2 | -3 | 1.7 | 16 | 22 | 11 | -3 | -5 | -5 | 4.5 | 8.2 | 10 | 9.9 | 7.4 | 6.6 | 3 | 1.2 | |
| | 4.8 | 4.5 | 6.4 | 9.4 | 9.4 | 10 | 8.3 | 3 | -1 | -5 | -5 | 3.5 | 37 | 48 | 26 | 1 | -7 | -5 | -0 | 5.2 | 7.7 | 9.8 | 7.3 | 7 | 4.1 | 2.1 | 3.9 |
| | 5.9 | 5.1 | 6.7 | 8.9 | 8.9 | 9.6 | 7.1 | 2.7 | -3 | -7 | -7 | 3.2 | 46 | | 48 | 2.6 | -4 | -8 | -3 | 2.8 | 6.4 | 8.8 | 7.3 | 7.1 | 5.1 | 3.9 | 5.9 |
| | 7 | 6.3 | 7.6 | 7.7 | 7 | 7.4 | 4.8 | 1.8 | -4 | -9 | -8 | -2 | 23 | 86 | 34 | 1.3 | -9 | -10 | -6 | 0.5 | 3.3 | 5.7 | 6.7 | 6.9 | 6.2 | 4.3 | 5.5 |
| | 8.5 | 8 | 8.3 | 8.2 | 6.6 | 6.7 | 3.3 | -0 | -6 | -9 | -7 | -7 | 10 | 23 | 18 | -1 | -9 | -9 | -7 | -2 | 2.2 | 3.5 | 5.3 | 6.1 | 6.9 | 5.5 | 6.5 |
FIG. 9C
WAVEFORM FOR MEASUREMENT
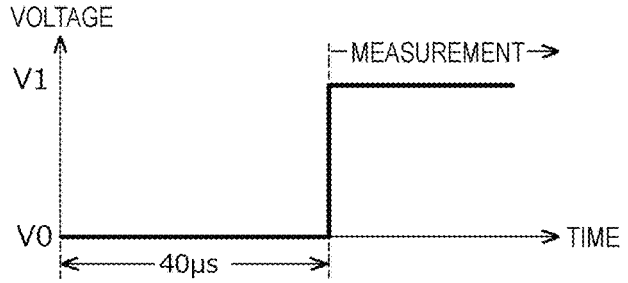
FIG. 10
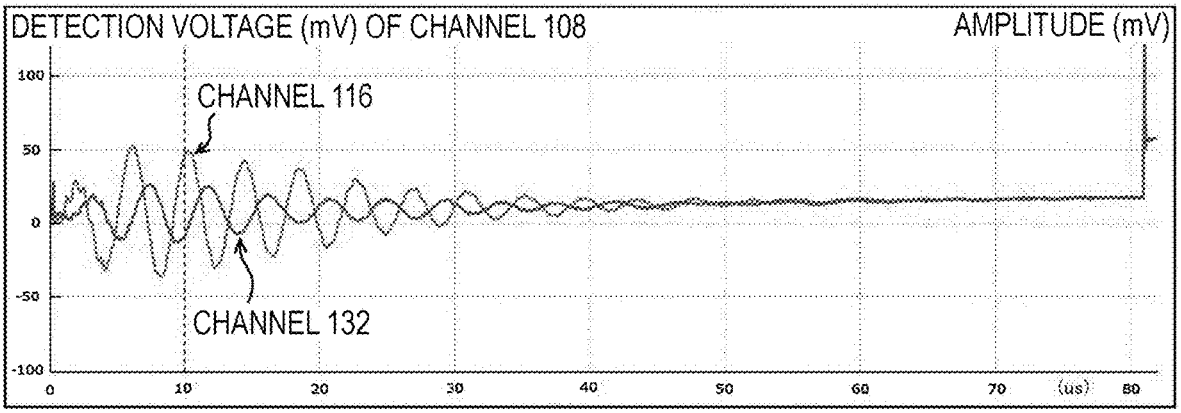

FIG. 16A

DRIVE TIMING

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| D | A | B | C | D | A | B | C | D | A | B | C | D | A | B | C | D | A | B | C | D | A | B | C | D | A | B | |
| | B | C | D | A | B | C | D | A | B | C | D | A | B | C | D | A | B | C | D | A | B | C | D | A | B | C | |
| | C | D | A | B | C | D | A | B | C | D | A | B | C | D | A | B | C | D | A | B | C | D | A | B | C | D | |
| | D | A | B | C | D | A | B | C | D | A | B | C | D | A | B | C | D | A | B | C | D | A | B | C | D | A | |
| | A | B | C | D | A | B | C | D | A | B | C | D | A | B | C | D | A | B | C | D | A | B | C | D | A | B | C |
| | B | C | D | A | B | C | D | A | B | C | D | A | B | C | D | A | B | C | D | A | B | C | D | A | B | C | D |
| | C | D | A | B | C | D | A | B | C | D | A | B | C | D | A | B | C | D | A | B | C | D | A | B | C | D | A |
| | D | A | B | C | D | A | B | C | D | A | B | C | D | A | B | C | D | A | B | C | D | A | B | C | D | A | B |

FIG. 16B

DELAY AMOUNT (μs)

| | | | | | | | | | | | | | | | | | | | | | | | | | | | |
|---|---|---|---|---|---|---|---|---|---|---|---|---|---|---|---|---|---|---|---|---|---|---|---|---|---|---|---|
| 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | |
| | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | |
| | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | |
| | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | |
| | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 |
| | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 |
| | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 |
| | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 | 2 | 3 | 0 | 1 |

X

Y

DELAY AMOUNT (μs) INCLUDING SHIFT TIME

| | | | | | | | | | | | | | |
|---|---|---|---|---|---|---|---|---|---|---|---|---|---|
| 0.02 | 1.04 | 2.06 | 3.08 | 0.02 | 1.04 | 2.06 | 3.08 | 0.02 | 1.04 | 2.06 | 3.08 | 0.02 | 1.04 |
| | 2.06 | 3.08 | 0.10 | 1.04 | 2.06 | 3.08 | 0.10 | 1.04 | 2.06 | 3.08 | 0.10 | 1.04 | 2.06 |
| | 3.08 | 0.10 | 1.12 | 2.06 | 3.08 | 0.10 | 1.12 | 2.06 | 3.08 | 0.10 | 1.12 | 2.06 | 3.08 |
| | 0.10 | 1.12 | 2.14 | 3.08 | 0.10 | 1.12 | 2.14 | 3.08 | 0.10 | 1.12 | 2.14 | 3.08 | 0.10 |
| | 1.12 | 2.14 | 3.16 | 0.10 | 1.12 | 2.14 | 3.16 | 0.10 | 1.12 | 2.14 | 3.16 | 0.10 | 1.12 |
| | 2.14 | 3.16 | 0.18 | 1.12 | 2.14 | 3.16 | 0.18 | 1.12 | 2.14 | 3.16 | 0.18 | 1.12 | 2.14 |
| | 3.16 | 0.18 | 1.20 | 2.14 | 3.16 | 0.18 | 1.20 | 2.14 | 3.16 | 0.18 | 1.20 | 2.14 | 3.16 |
| | 0.18 | 1.20 | 2.22 | 3.16 | 0.18 | 1.20 | 2.22 | 3.16 | 0.18 | 1.20 | 2.22 | 3.16 | 0.18 |

| | | | | | | | | | | | | | |
|---|---|---|---|---|---|---|---|---|---|---|---|---|---|
| 2.06 | 3.08 | 0.02 | 1.04 | 2.06 | 3.08 | 0.02 | 1.04 | 2.06 | 3.08 | 0.02 | 1.04 | 2.06 | |
| 3.08 | 0.10 | 1.04 | 2.06 | 3.08 | 0.10 | 1.04 | 2.06 | 3.08 | 0.10 | 1.04 | 2.06 | 3.08 | |
| 0.10 | 1.12 | 2.06 | 3.08 | 0.10 | 1.12 | 2.06 | 3.08 | 0.10 | 1.12 | 2.06 | 3.08 | 0.10 | |
| 1.12 | 2.14 | 3.08 | 0.10 | 1.12 | 2.14 | 3.08 | 0.10 | 1.12 | 2.14 | 3.08 | 0.10 | 1.12 | |
| 2.14 | 3.16 | 0.10 | 1.12 | 2.14 | 3.16 | 0.10 | 1.12 | 2.14 | 3.16 | 0.10 | 1.12 | 2.14 | 3.16 |
| 3.16 | 0.18 | 1.12 | 2.14 | 3.16 | 0.18 | 1.12 | 2.14 | 3.16 | 0.18 | 1.12 | 2.14 | 3.16 | 0.18 |
| 0.18 | 1.20 | 2.14 | 3.16 | 0.18 | 1.20 | 2.14 | 3.16 | 0.18 | 1.20 | 2.14 | 3.16 | 0.18 | 1.20 |
| 1.20 | 2.22 | 3.16 | 0.18 | 1.20 | 2.22 | 3.16 | 0.18 | 1.20 | 2.22 | 3.16 | 0.18 | 1.20 | 2.22 |

FIG. 20

| | DELAY AMOUNT (μs) |
|---|---|
| DELAY 1 | 0.02 |
| DELAY 2 | 1.04 |
| DELAY 3 | 2.06 |
| DELAY 4 | 3.08 |
| DELAY 5 | 0.10 |
| DELAY 6 | 1.12 |
| DELAY 7 | 2.14 |
| DELAY 8 | 3.16 |
| DELAY 9 | 0.18 |
| DELAY 10 | 1.20 |
| DELAY 11 | 2.22 |

FIG. 21

| M \ N | 4n+1-TH COLUMN | 4n+2-TH COLUMN | 4n+3-TH COLUMN | 4n+4-TH COLUMN |
|---|---|---|---|---|
| FIRST ROW | DELAY 1 | DELAY 2 | DELAY 3 | DELAY 4 |
| SECOND ROW | DELAY 2 | DELAY 3 | DELAY 4 | DELAY 5 |
| THIRD ROW | DELAY 3 | DELAY 4 | DELAY 5 | DELAY 6 |
| FOURTH ROW | DELAY 4 | DELAY 5 | DELAY 6 | DELAY 7 |
| FIFTH ROW | DELAY 5 | DELAY 6 | DELAY 7 | DELAY 8 |
| SIXTH ROW | DELAY 6 | DELAY 7 | DELAY 8 | DELAY 9 |
| SEVENTH ROW | DELAY 7 | DELAY 8 | DELAY 9 | DELAY 10 |
| EIGHTH ROW | DELAY 8 | DELAY 9 | DELAY 10 | DELAY 11 |

FIG. 22

| | FIRST COLUMN | SECOND COLUMN | THIRD COLUMN | FOURTH COLUMN | FIFTH COLUMN | SIXTH COLUMN | SEVENTH COLUMN | EIGHTH COLUMN | NINTH COLUMN | TENTH COLUMN | ELEVENTH COLUMN | TWELFTH COLUMN | ... | TWENTY-FIFTH COLUMN | TWENTY-SIXTH COLUMN | TWENTY-SEVENTH COLUMN | TWENTY-EIGHTH COLUMN |
|---|---|---|---|---|---|---|---|---|---|---|---|---|---|---|---|---|---|
| FIRST ROW | DELAY 1 | DELAY 2 | DELAY 3 | DELAY 4 | DELAY 1 | DELAY 2 | DELAY 3 | DELAY 4 | DELAY 1 | DELAY 2 | DELAY 3 | DELAY 4 | | DELAY 1 | DELAY 2 | DELAY 3 | DELAY 4 |
| SECOND ROW | DELAY 2 | DELAY 3 | DELAY 4 | DELAY 5 | DELAY 2 | DELAY 3 | DELAY 4 | DELAY 5 | DELAY 2 | DELAY 3 | DELAY 4 | DELAY 5 | | DELAY 2 | DELAY 3 | DELAY 4 | DELAY 5 |
| THIRD ROW | DELAY 3 | DELAY 4 | DELAY 5 | DELAY 6 | DELAY 3 | DELAY 4 | DELAY 5 | DELAY 6 | DELAY 3 | DELAY 4 | DELAY 5 | DELAY 6 | | DELAY 3 | DELAY 4 | DELAY 5 | DELAY 6 |
| FOURTH ROW | DELAY 4 | DELAY 5 | DELAY 6 | DELAY 7 | DELAY 4 | DELAY 5 | DELAY 6 | DELAY 7 | DELAY 4 | DELAY 5 | DELAY 6 | DELAY 7 | | DELAY 4 | DELAY 5 | DELAY 6 | DELAY 7 |
| FIFTH ROW | DELAY 5 | DELAY 6 | DELAY 7 | DELAY 8 | DELAY 5 | DELAY 6 | DELAY 7 | DELAY 8 | DELAY 5 | DELAY 6 | DELAY 7 | DELAY 8 | | DELAY 5 | DELAY 6 | DELAY 7 | DELAY 8 |
| SIXTH ROW | DELAY 6 | DELAY 7 | DELAY 8 | DELAY 9 | DELAY 6 | DELAY 7 | DELAY 8 | DELAY 9 | DELAY 6 | DELAY 7 | DELAY 8 | DELAY 9 | | DELAY 6 | DELAY 7 | DELAY 8 | DELAY 9 |
| SEVENTH ROW | DELAY 7 | DELAY 8 | DELAY 9 | DELAY 10 | DELAY 7 | DELAY 8 | DELAY 9 | DELAY 10 | DELAY 7 | DELAY 8 | DELAY 9 | DELAY 10 | | DELAY 7 | DELAY 8 | DELAY 9 | DELAY 10 |
| EIGHTH ROW | DELAY 8 | DELAY 9 | DELAY 10 | DELAY 11 | DELAY 8 | DELAY 9 | DELAY 10 | DELAY 11 | DELAY 8 | DELAY 9 | DELAY 10 | DELAY 11 | | DELAY 8 | DELAY 9 | DELAY 10 | DELAY 11 |

X
Y
P

FIG. 23

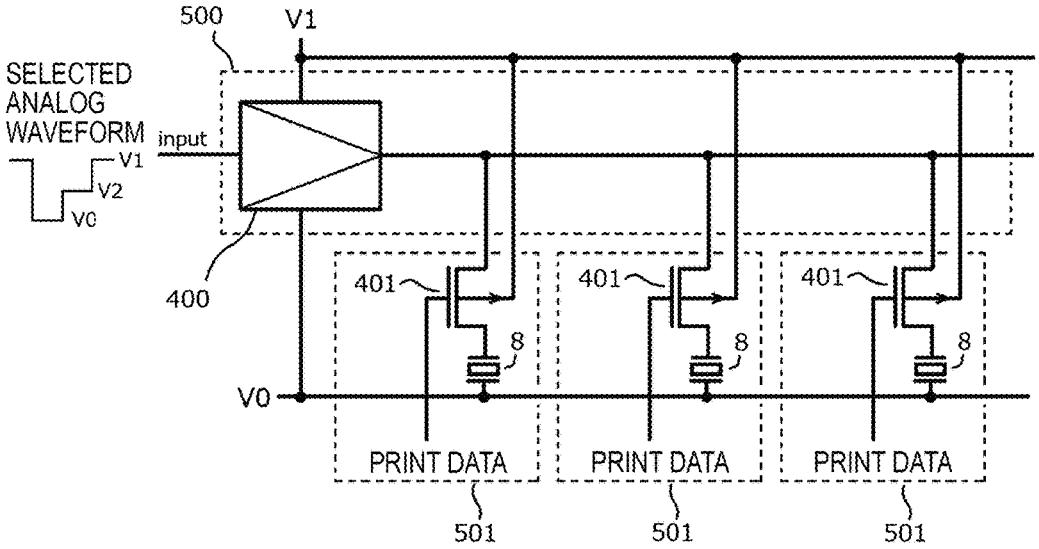

| state | OUTPUT WAVEFORM |
|---|---|
| 0 | V0 |
| 2 | V2 |
| 1 | V1 |

FIG. 26A
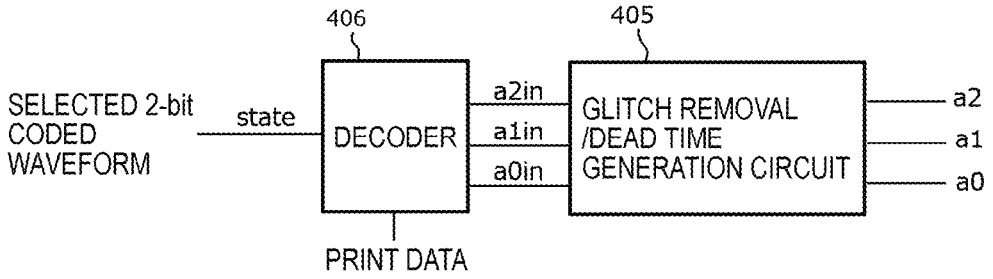
FIG. 26B-1
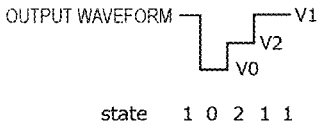
FIG. 26B-2
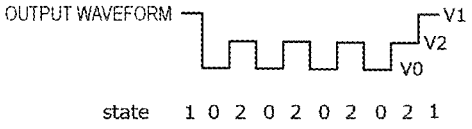
FIG. 26C
| PRINT DATA | state | a0 | a1 | a2 | Q0 | Q1 | Q2 | OUTPUT WAVEFORM |
|---|---|---|---|---|---|---|---|---|
| 0 | X | L | **H** | L | off | **on** | off | V1 |
| 1 | 0 | **H** | L | L | **on** | off | off | V0 |
| | 1 | L | **H** | L | off | **on** | off | V1 |
| | 2 | L | L | **H** | off | off | **on** | V2 |
| | 3 | L | L | L | off | off | off | off |
FIG. 26D
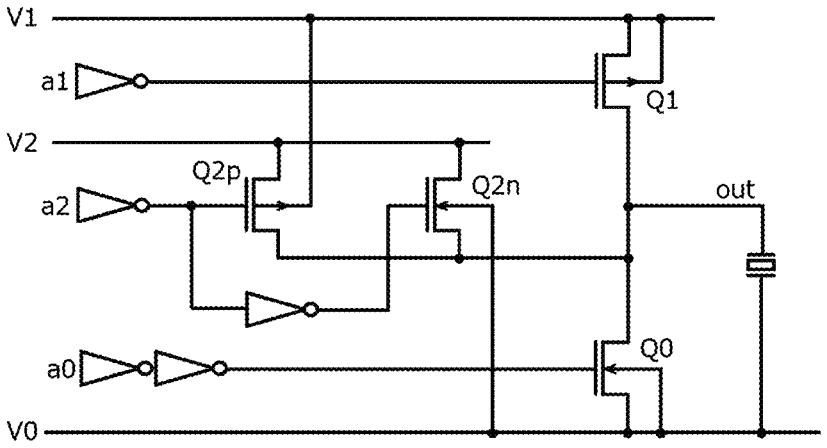

DRIVE TIMING

B1 A1 B2 A2 B1 A1 B2 A2 B1 A1 B2 A2 B1 A1 B2 A2 B1 A1 B2 A2 B1 A1 B2 A2 B1 A1 B2
B1 A1 B2 A2 B1 A1 B2 A2 B1 A1 B2 A2 B1 A1 B2 A2 B1 A1 B2 A2 B1 A1 B2 A2 B1 A1
A2 B1 A1 B2 A2 B1 A1 B2 A2 B1 A1 B2 A2 B1 A1 B2 A2 B1 A1 B2 A2 B1 A1 B2 A2 B1
B2 A2 B1 A1 B2 A2 B1 A1 B2 A2 B1 A1 B2 A2 B1 A1 B2 A2 B1 A1 B2 A2 B1 A1 B2 A2
A1 B2 A2 B1 A1 B2 A2 B1 A1 B2 A2 B1 A1 B2 A2 B1 A1 B2 A2 B1 A1 B2 A2 B1 A1 B2 A2
B1 A1 B2 A2 B1 A1 B2 A2 B1 A1 B2 A2 B1 A1 B2 A2 B1 A1 B2 A2 B1 A1 B2 A2 B1 A1 B2
A2 B1 A1 B2 A2 B1 A1 B2 A2 B1 A1 B2 A2 B1 A1 B2 A2 B1 A1 B2 A2 B1 A1 B2 A2 B1 A1
B2 A2 B1 A1 B2 A2 B1 A1 B2 A2 B1 A1 B2 A2 B1 A1 B2 A2 B1 A1 B2 A2 B1 A1 B2 A2 B1

| | DELAY AMOUNT (μs) |
|---|---|
| DELAY 1 | 12.02 |
| DELAY 2 | 1.04 |
| DELAY 3 | 14.06 |
| DELAY 4 | 3.08 |
| DELAY 5 | 12.10 |
| DELAY 6 | 1.12 |
| DELAY 7 | 14.14 |
| DELAY 8 | 3.16 |
| DELAY 9 | 12.18 |
| DELAY 10 | 1.20 |
| DELAY 11 | 14.22 |

LIQUID EJECTION DEVICE AND MULTI-NOZZLE LIQUID EJECTION DEVICE

CROSS-REFERENCE TO RELATED APPLICATION

This application is based upon and claims the benefit of priority from Japanese Patent Application No. 2018-159766, filed on Aug. 28, 2018, the entire contents of which are incorporated herein by reference.

FIELD

Embodiments described herein relate generally to a liquid ejection device and a multi-nozzle liquid ejection device.

BACKGROUND

There is known a liquid ejection device which supplies a predetermined amount of liquid to a predetermined position. The liquid ejection device is mounted on an inkjet printer, a 3D printer, a dispensing device, or the like. The inkjet printer ejects ink droplets from an ink jet head to form an image or the like on a surface of a recording medium. The 3D printer ejects and cures droplets of a shaping material from a shaping-material ejection head to form a three-dimensional shaped object. The dispensing device ejects droplets of a sample and supplies a predetermined amount to a plurality of containers or the like.

A liquid ejection device which drives an actuator to eject ink and includes a plurality of nozzles drives and a plurality of actuators at the same phase or drives the actuators with the phases shifted slightly in order to avoid the concentration of a drive current. However, if a plurality of actuators is driven at almost the same timing, the ink ejection may become unstable due to a crosstalk in which the operations of the actuators interfere with each other.

DESCRIPTION OF THE DRAWINGS

FIGS. 9A to 9C are distribution charts obtained by plotting channel numbers of channels arranged on the nozzle plate and magnitudes of pressures which respective channels give to an attention channel 108;

FIG. 10 is a graph illustrating pressure waveforms (residual vibration waveform) appearing in the attention channel 108 when a channel 116 and a channel 132 are driven individually;

FIGS. 16A and 16B are a matrix in which the drive timings A to D are regularly allocated to all the channels and a matrix illustrating a distribution of delay amounts of the channels;

FIG. 20 is a view for explaining setting values of the delay amounts stored in a delay time setting memory;

FIG. 21 is a view for explaining an allocation pattern of delays in a predetermined array stored in a drive waveform selection memory;

FIG. 22 is a matrix in which delays 1 to 11 are allocated to respective channels by repeatedly applying the allocation pattern;

FIG. 23 is another configuration example of the drive circuit which gives the drive signal to each channel;

FIGS. 26A to 26D are still another configuration example of the drive circuit which gives the drive signal to each channel;

DETAILED DESCRIPTION

Figure 1:
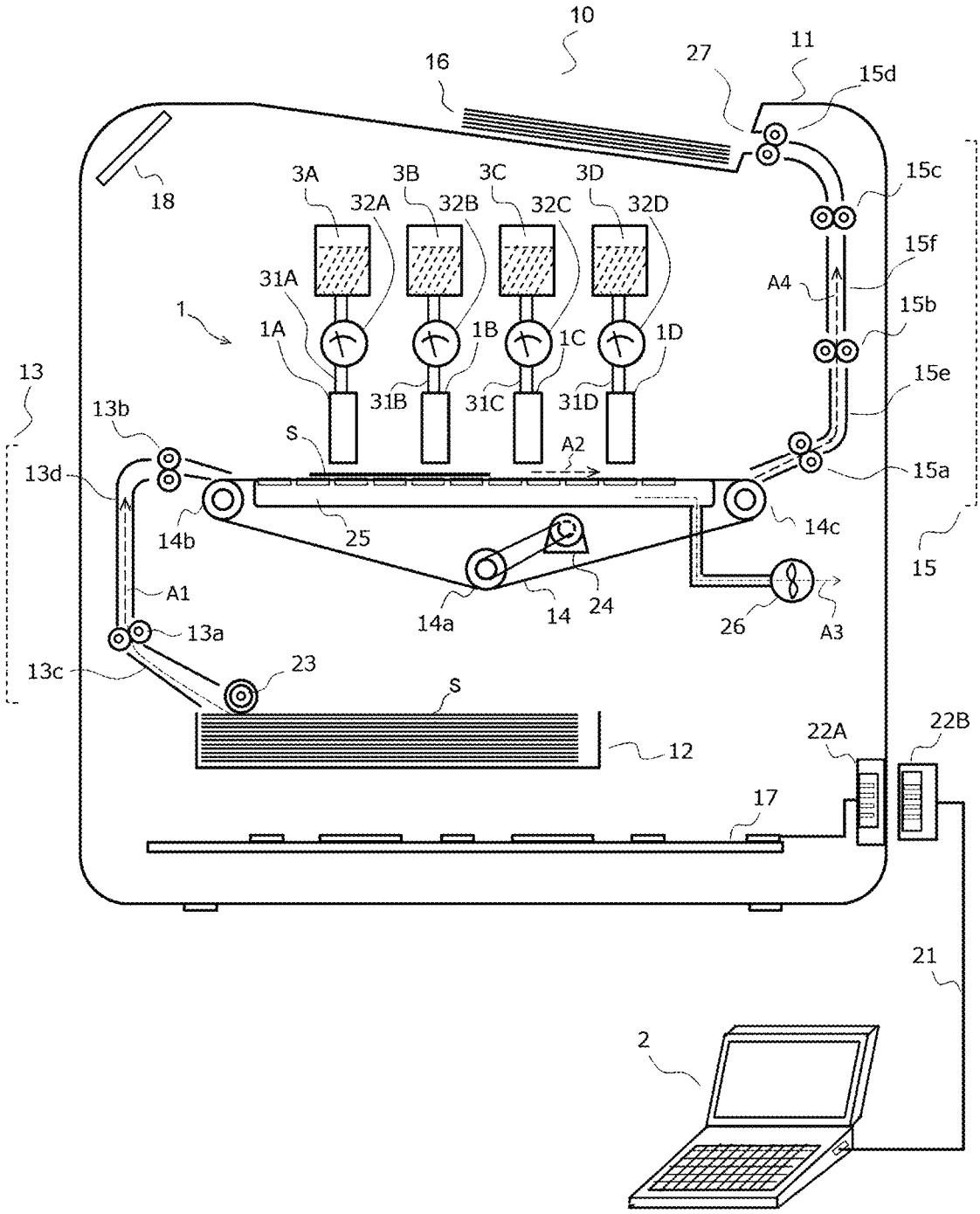
FIG. 1 is a longitudinal sectional view of an inkjet printer including a liquid ejection device of a first embodiment.

Embodiments provide a liquid ejection device and a multi-nozzle liquid ejection device in which a stable liquid ejection can be performed by preventing a crosstalk in which operations of actuators interfere with each other.

In general, according to one embodiment, a liquid ejection device includes a nozzle plate, an actuator, a liquid supply unit, a waveform generation circuit, a waveform allocation circuit, and a drive signal output circuit. A plurality of nozzles for ejecting liquid are arranged in the nozzle plate. The actuator is provided in each of the nozzles. The waveform generation circuit generates plural kinds of drive waveforms with different generation start timings. The waveform allocation circuit can set the drive waveform among plural kinds of drive waveforms and the actuator of the nozzle to be allocated. The drive signal output circuit drives the actuator with the allocated drive waveform.

Hereinafter, a liquid ejection device according to the embodiment will be described with reference to the accompanying drawings. In the drawings, the same configurations are denoted by the same reference numerals.

First Embodiment

An inkjet printer 10 which prints an image on a recording medium is described as one example of an image forming device mounted with a liquid ejection device 1 of an embodiment. FIG. 1 illustrates a schematic configuration of the inkjet printer 10. For example, the inkjet printer 10 includes a box-shaped housing 11 which is an exterior body. A cassette 12 which stores a sheet S which is one example of the recording medium, an upstream conveyance path 13 of the sheet S, a conveyance belt 14 which conveys the sheet S picked up from the inside of the cassette 12, ink jet heads 1A to 1D which eject ink droplets toward the sheet S on the conveyance belt 14, a downstream conveyance path 15 of the sheet S, a discharge tray 16, and a control board 17 are arranged inside the housing 11. An operation part 18 as a user interface is arranged on the upper side of the housing 11.

Data of the image printed on the sheet S is generated by a computer 2 which is external connection equipment, for example. The image data generated by the computer 2 is transmitted to the control board 17 of the inkjet printer 10 through a cable 21 and connectors 22B and 22A.

A pickup roller 23 supplies the sheets S one by one from the cassette 12 to the upstream conveyance path 13. The upstream conveyance path 13 is configured by a feed roller pair 13*a* and 13*b* and sheet guide plates 13*c* and 13*d*. The sheet S is fed to the upper surface of the conveyance belt 14 through the upstream conveyance path 13. Arrow A1 in the drawing indicates a conveyance path of the sheet S from the cassette 12 to the conveyance belt 14.

The conveyance belt 14 is a reticular endless belt in which a large number of through holes are formed on the surface. Three rollers, a drive roller 14*a* and driven rollers 14*b* and 14*c*, rotatably support the conveyance belt 14. A motor 24 rotates the conveyance belt 14 by rotating the drive roller 14*a*. The motor 24 is one example of a driving device. In the drawing, A2 indicates a rotation direction of the conveyance belt 14. A negative pressure container 25 is arranged on a back surface side of the conveyance belt 14. The negative pressure container 25 is connected to a fan 26 for reducing pressure, and the inner pressure of the container becomes negative by the air flow formed by the fan 26. When the inner pressure of the negative pressure container 25 becomes negative, the sheet S is sucked and held on the upper surface of the conveyance belt 14. In the drawing, A3 indicates the flow of air.

The inkjet heads 1A to 1D are arranged to face the sheet S sucked and held on the conveyance belt 14 through a slight gap of 1 mm, for example. The inkjet heads 1A to 1D each eject the ink droplets toward the sheet S. An image is formed on the sheet S when the sheet passes below the ink jet heads 1A to 1D. The ink jet heads 1A to 1D have the same structure except for the color of the ejected ink. The color of the ink is cyan, magenta, yellow, or black, for example.

The ink jet heads 1A to 1D are connected through ink passages 31A to 31D with ink tanks 3A to 3D and ink supply pressure adjusting devices 32A to 32D, respectively. For example, the ink passages 31A to 31D are resin tubes. The ink tanks 3A to 3D are containers which store ink. The ink tanks 3A to 3D are arranged above the ink jet heads 1A to 1D, respectively. During standby, the ink supply pressure adjusting devices 32A to 32D respectively adjust the inner pressures of the inkjet heads 1A to 1D to be negative compared to the atmospheric pressure, for example, −1 kPa, to prevent that the ink leaks out from nozzles 51 (see FIG. 2) of the ink jet heads 1A to 1D. During formation of an image, the inks of the ink tanks 3A to 3D are supplied to the ink jet heads 1A to 1D by the ink supply pressure adjusting devices 32A to 32D, respectively.

After forming the image, the sheet S is fed from the conveyance belt 14 to the downstream conveyance path 15. The downstream conveyance path 15 is configured by feed roller pairs 15*a*, 15*b*, 15*c*, and 15*d* and sheet guide plates 15*e* and 15*f* defining the conveyance path of the sheet S. The sheet S is fed from a discharge port 27 to the discharge tray 16 through the downstream conveyance path 15. In the drawing, an arrow A4 indicates the conveyance path of the sheet S.

Subsequently, the configuration of the ink jet head 1A will be described with reference to FIGS. 2 to 6. Incidentally, the ink jet heads 1B to 1D have the structure as the ink jet head 1A, and the description is not given in detail.

Figure 2:
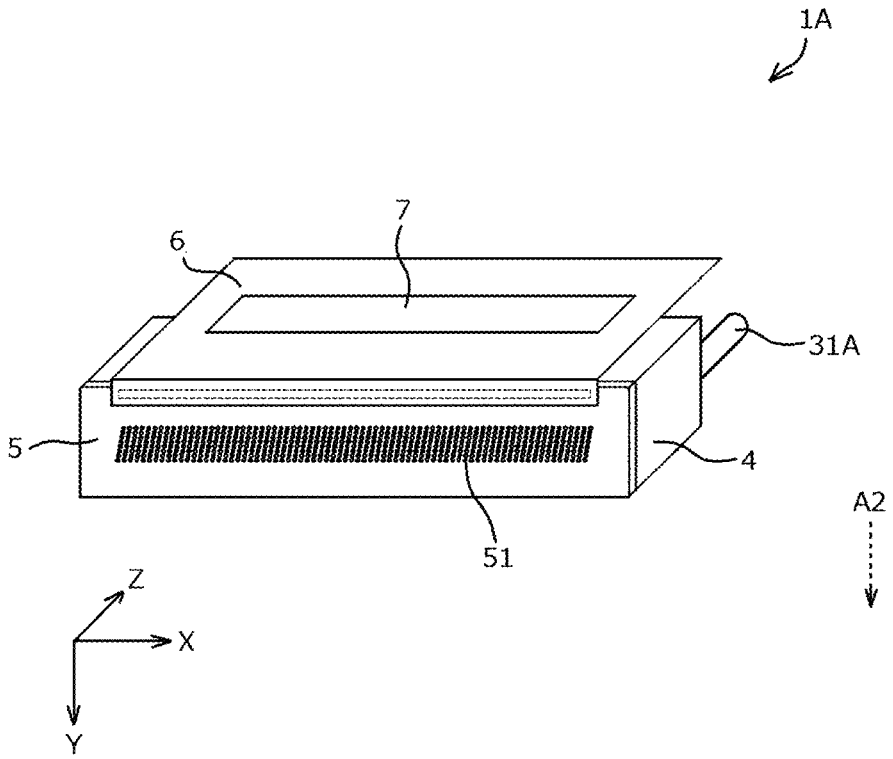
FIG. 2 is a perspective view of an ink jet head of the inkjet printer.

FIG. 2 is a perspective view of the appearance of the ink jet head 1A. The ink jet head 1A includes an ink supply part 4, a nozzle plate 5, a flexible board 6, and a drive circuit 7. A plurality of nozzles 51 for ejecting ink are arranged in the nozzle plate 5. The ink ejected from the nozzles 51 is supplied from the ink supply part 4 communicating with the nozzles 51. The ink passage 31A from the ink supply pressure adjusting device 32A is connected to the upper side of the ink supply part 4. An arrow A2 indicates the rotation direction of the above-described conveyance belt 14 (see FIG. 1).

Figure 3:
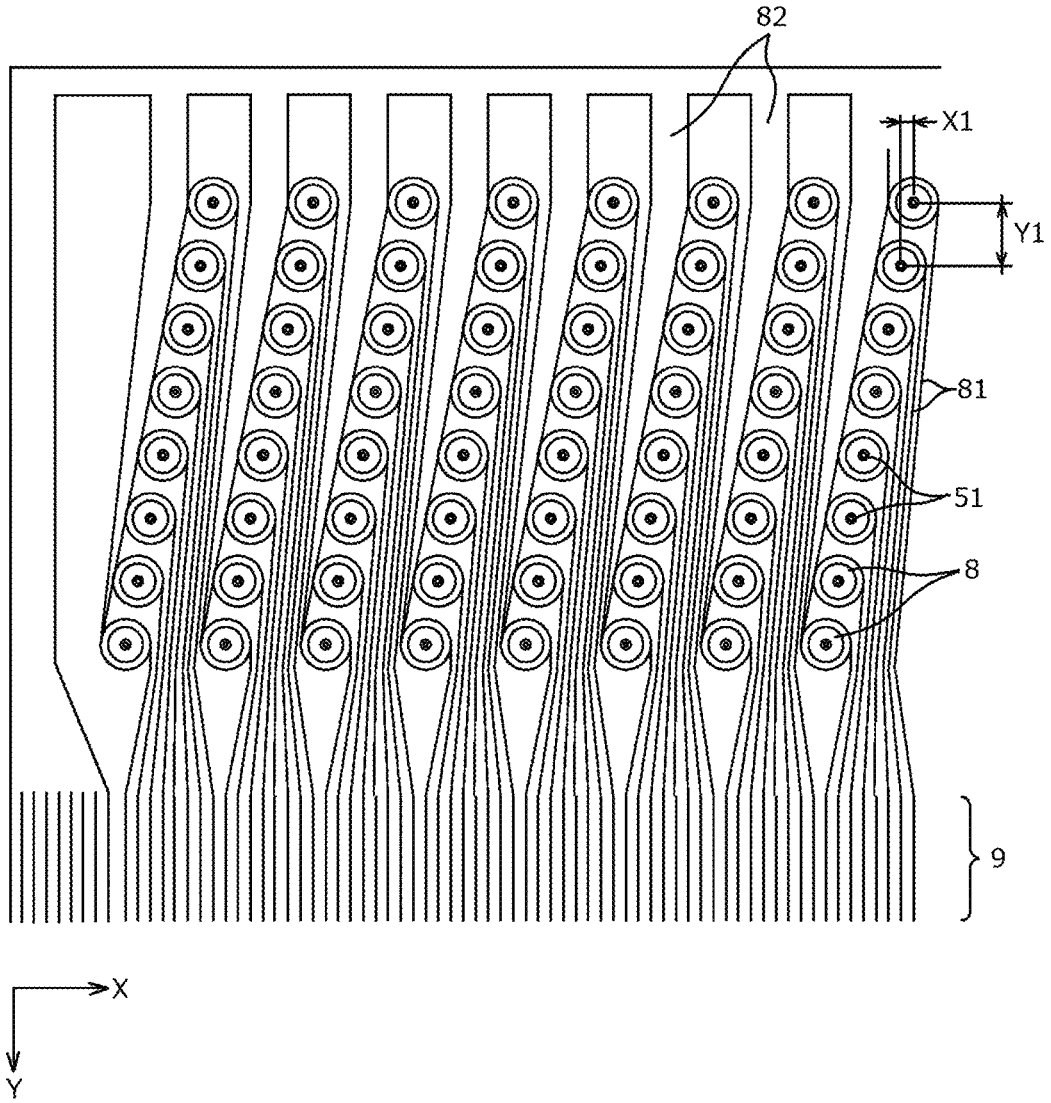
FIG. 3 is a plan view of a nozzle and an actuator arranged on a nozzle plate of the ink jet head.

FIG. 3 is an enlarged plan view partially illustrating the nozzle plate 5. The nozzles 51 are two-dimensionally arranged in a column direction (X-axis direction) and a row direction (Y-axis direction). However, the nozzles 51 arranged in the row direction (Y-axis direction) are obliquely arranged such that the nozzles 51 are not overlapped on the axis of a Y axis. The nozzles 51 are arranged to have gaps of a distance X1 in the X-axis direction and a distance Y1 of in the Y-axis direction. As one example, the distance X1 is 42.4 μm, and the distance Y1 is 250 μm. That is, the distance X1 is determined such that a recording density of 600 DPI is formed in the X-axis direction. The distance Y1 is determined based on a relation between a rotational speed of the conveyance belt 14 and a time required until impact of ink, to print at 600 DPI in the Y-axis direction. When eight nozzles 51 arranged in the Y-axis direction are set as one set, plural sets of nozzles 51 are arranged in the X-axis direction. Although not illustrated, for example, 150 sets of nozzles are arranged, and thus a total of 1,200 nozzles 51 are arranged.

An actuator 8 serving as a driving source of the operation of ejecting ink is provided at each of the nozzles 51. Each actuator 8 is formed in an annular shape and is arranged such that the nozzle 51 is positioned at the center thereof. One set of the nozzles 51 and the actuator 8 configure one channel. For example, the size of the actuator 8 is an inner diameter of 30 μm and an outer diameter of 140 μm. The actuators 8 are connected electrically with the individual electrodes 81, respectively. In the actuators 8, eight actuators 8 arranged in the Y-axis direction are connected electrically by a common electrode 82. The individual electrodes 81 and the common electrodes 82 are connected electrically with a mounting pad 9. The mounting pad 9 serves as an input port for giving a drive signal (electric signal) to the actuator 8. The individual electrodes 81 give the drive signals to the actuators 8, respectively. The actuators 8 are driven according to the given drive signals. In FIG. 3, the actuator 8, the individual electrode 81, the common electrode 82, and the mounting pad 9 are described by a solid line for convenience of explanation. However, those parts are arranged inside the nozzle plate 5 (see the longitudinal sectional view of FIG. 4).

The mounting pad 9 is connected electrically with a wiring pattern formed in the flexible board 6 through an anisotropic contact film (ACF), for example. The wiring pattern of the flexible board 6 is connected electrically with the drive circuit 7. The drive circuit 7 is an integrated circuit (IC), for example. The drive circuit 7 generates the drive signal which is given to the actuator 8.

Figure 4:
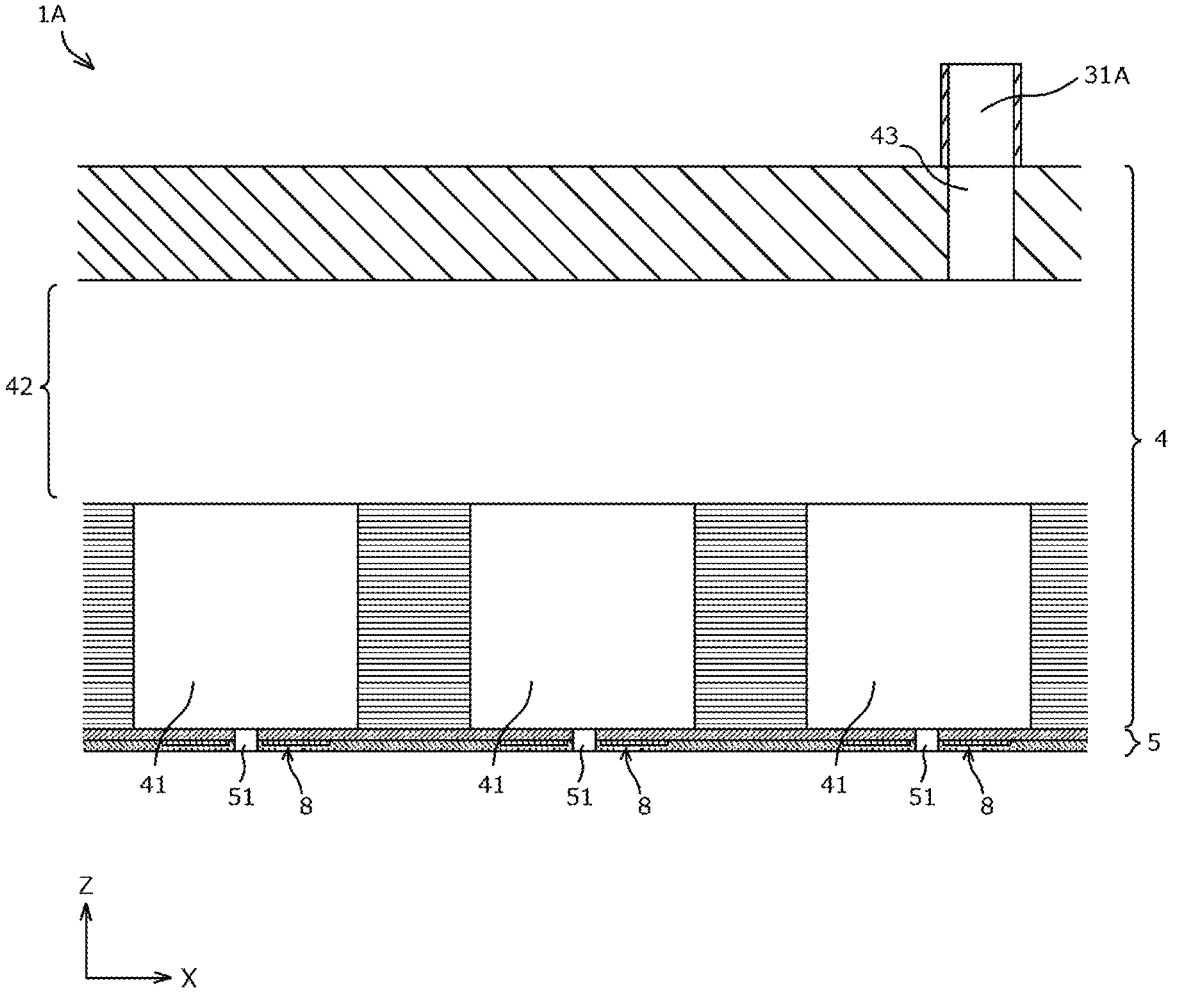
FIG. 4 is a longitudinal sectional view of the ink jet head.

FIG. 4 is a longitudinal sectional view of the ink jet head 1A. As illustrated in FIG. 4, the nozzle 51 penetrates the nozzle plate 5 in a Z-axis direction. For example, the size of the nozzle 51 is a diameter of 20 μm and a length of 8 μm. A plurality of pressure chambers (individual pressure chamber) 41 communicating with the respective nozzles 51 are provided inside the ink supply part 4. The pressure chamber 41 is a cylindrical space of which the upper portion is open, for example. The upper portions of the pressure chambers 41 are open and communicate with a common ink chamber 42. The ink passage 31A communicates with the common ink chamber 42 through an ink supply port 43. The pressure chambers 41 and the common ink chamber 42 are filled with ink. In some cases, the common ink chamber 42 is formed in a passage shape for circulating ink, for example. For example, the pressure chamber 41 is configured such that a cylindrical hole having a diameter of 200 μm is formed in a single crystal silicon wafer having a thickness of 500 μm. For example, the ink supply part 4 is configured such that the space corresponding to the common ink chamber 42 is formed in alumina ($Al_2O_3$).

Figure 5:
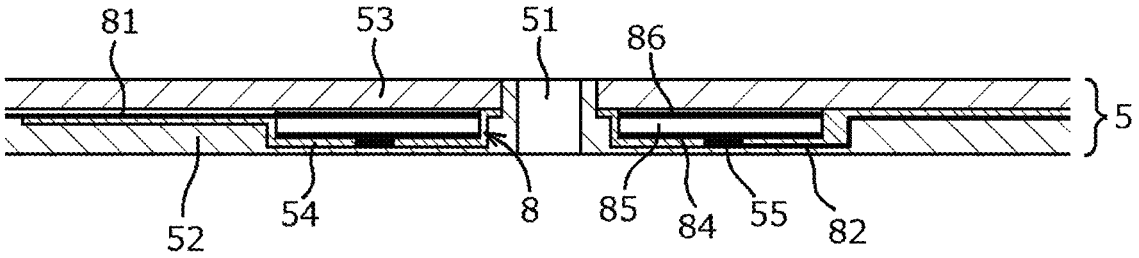
FIG. 5 is a longitudinal sectional view of the nozzle plate of the ink jet head.

FIG. 5 is an enlarged view partially illustrating the nozzle plate 5. The nozzle plate 5 has a structure in which a protective layer 52, the actuator 8, and a diaphragm 53 are laminated in order from the bottom surface side. The actuator 8 has a structure in which a lower electrode 84, a thin plate-shaped piezoelectric body 85, and an upper electrode 86 are laminated. The upper electrode 86 is connected electrically with the individual electrode 81, and the lower electrode 84 is connected electrically with the common electrode 82. An insulating layer 54 for preventing the short circuit of the individual electrode 81 and the common electrode 82 is interposed at the boundary between the protective layer 52 and the diaphragm 53. For example, the insulating layer 54 is formed of a silicon dioxide film ($SiO_2$) to have a thickness of 0.5 μm. The lower electrode 84 and the common electrode 82 are connected electrically by a contact hole 55 formed in the insulating layer 54. Considering piezoelectric property and dielectric breakdown voltage, the piezoelectric body 85 is formed of lead zirconate titanate (PZT) to have a thickness of 5 μm or less, for example. For example, the upper electrode 86 and the lower electrode 84 are formed of platinum to have a thickness of 0.15 μm. For example, the individual electrode 81 and the common electrode 82 are formed of gold (Au) to have a thickness of 0.3 μm.

The diaphragm 53 is formed of an insulating inorganic material. For example, the insulating inorganic material is silicon dioxide ($SiO_2$). For example, the thickness of the diaphragm 53 is 2 to 10 μm and preferably 4 to 6 μm. Although illustrated below in detail, the diaphragm 53 and the protective layer 52 are bent inward when the piezoelectric body 85 applied with voltage is deformed into a $d_{31}$ mode. Then, the diaphragm and the protective layer return to the original when the application of voltage to the piezoelectric body 85 is stopped. The volume of the pressure chamber (individual pressure chamber) 41 expands and contracts according to the reversible deformation. When the volume of the pressure chamber 41 is changed, the ink pressure in the pressure chamber 41 is changed.

For example, the protective layer 52 is formed of polyimide to have a thickness of 4 μm. The protective layer 52 covers one surface of the nozzle plate 5 on the bottom surface side and further covers the inner peripheral surface of the hole of the nozzle 51.

Figure 6:
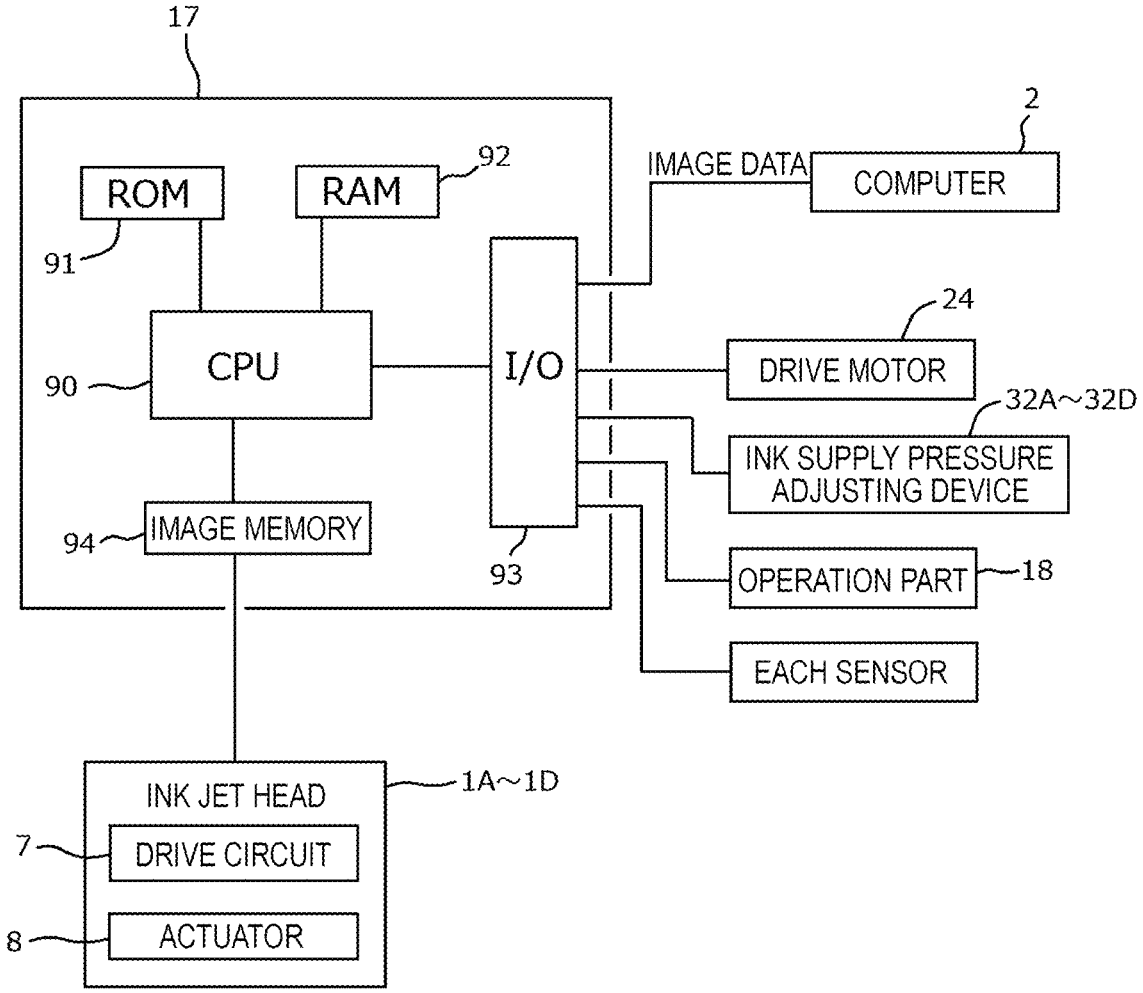
FIG. 6 is a block configuration diagram of a control system of the inkjet printer.

FIG. 6 is a block diagram of a control system of the inkjet printer 10. The control board 17 as a control part is mounted with a CPU 90, an ROM 91, and an RAM 92, an I/O port 93 which is an input/output port, and an image memory 94. The CPU 90 controls the drive motor 24, the ink supply pressure adjusting devices 32A to 32D, the operation part 18, and various sensors through the I/O port 93. Print data corresponding to the image data generated by the computer 2 which is external connection equipment is transmitted through the I/O port 93 to the control board 17 and is stored in the image memory 94. The CPU 90 transmits the print data stored in the image memory 94 to the drive circuit 7 in the drawing order.

Figure 7:
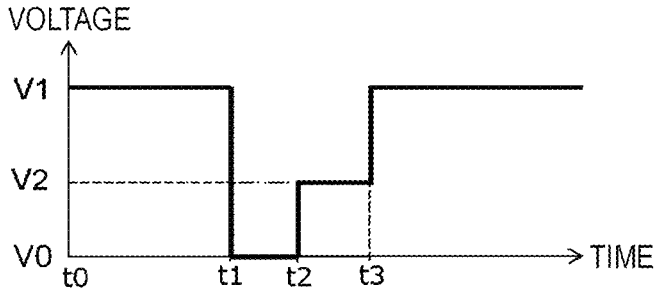
FIG. 7 is a drive waveform for driving the actuator of the ink jet head.

Subsequently, the drive waveform of the drive signal given to the actuator 8 and the operation of ejecting ink from the nozzle 51 are described with reference to FIGS. 7 to 8E. FIG. 7 illustrates the drive waveform of a single pulse of dropping ink droplets once in one time of drive period as one example of the drive waveform. The drive waveform of FIG. 7 is a so-called pulling striking of drive waveform. However, the drive waveform is not limited to the single pulse. For example, multi drops, such as double pulses or triple pulses, of dropping the ink droplets plural times in one time of drive period may be performed. The drive waveform is not limited to the pulling striking and may be a pushing striking or a pushing and pulling striking.

The drive circuit 7 applies a bias voltage V1 to the actuator 8 from time t0 to time t1. That is, the voltage V1 is applied between the upper electrode 86 and the lower electrode 84. After a voltage V0 (=0 V) is applied until time t2 from time t1 of starting ink ejection operation, a voltage V2 is applied from time t2 to time t3 to eject ink droplets. After completion of ejection, the bias voltage V1 is applied at time t3 to attenuate a vibration in the pressure chamber 41. The voltage V2 is a voltage smaller than the bias voltage V1. For example, the voltage value is determined based on the attenuation rate of the pressure vibration of the ink in the pressure chamber 41. The time from time t1 to time t2 and the time from time t2 to time t3 are each set to a half period of a natural vibration period λ determined by the property of the ink and the inner structure of the head. The half period of the natural vibration period λ is also referred to as acoustic length (AL). During a series of operations, the voltage of the common electrode 82 is made constant at 0 V.

Figure 8A:
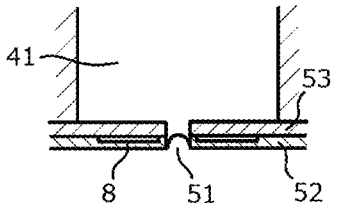
FIGS. 8A to 8E are views for explaining an operation of the actuator.
Figure 8D:
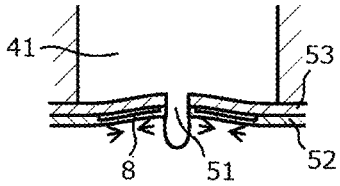
Figure 8B:
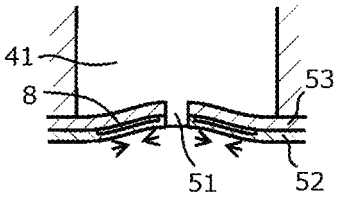
Figure 8E:
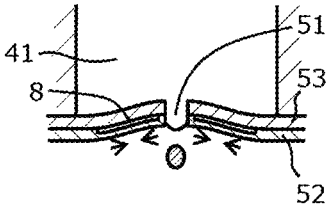

FIGS. 8A to 8E schematically illustrate the operation of driving the actuator 8 with the drive waveform of FIG. 7 to eject ink. In the standby state, the pressure chamber 41 is filled with ink. As illustrated in FIG. 8A, the meniscus position of the ink in the nozzle 51 is stationary near zero. When the bias voltage V1 is applied as a contraction pulse from time t0 to time t1, an electric field is generated in a thickness direction of the piezoelectric body 85, and the deformation of the $d_{31}$ mode occurs in the piezoelectric body 85 as illustrated in FIG. 8B. Specifically, the annular piezoelectric body 85 extends in the thickness direction and contracts in a radial direction. Although compressive stresses are generated in the diaphragm 53 and the protective layer 52 by the deformation of the piezoelectric body 85, the compressive force generated in the diaphragm 53 is larger than the compressive force generated in the protective layer 52, so that the actuator 8 is bent inward. That is, the actuator 8 is deformed to be a depression centered on the nozzle 51, and the volume of the pressure chamber 41 is contracted.

Figure 8C:
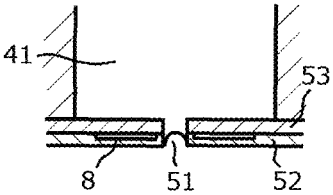

In time t1, when the voltage V0 (=0 V) is applied as an expansion pulse, the actuator 8 returns to a state before the deformation as schematically illustrated in FIG. 8C. At this time, in the pressure chamber 41, the inner ink pressure is lowered due to the return of the volume to the original state. However, ink is supplied from the common ink chamber 42 to the pressure chamber 41 so that the ink pressure rises. Thereafter, when the time reaches time t2, the ink supply to the pressure chamber 41 is stopped, and the rise of the ink pressure is also stopped. That is, the state becomes a so-called pulling state.

In time t2, when the voltage V2 is applied as the contraction pulse, as schematically illustrated in FIG. 8D, the piezoelectric body 85 of the actuator 8 is deformed again so that the volume of the pressure chamber 41 is contracted. As described above, the ink pressure rises between time t1 and time t2, and further the ink pressure is raised when the pressure chamber 41 is pushed by the actuator 8 to reduce the volume of the pressure chamber 41, so that the ink is extruded from the nozzle 51. The application of the voltage V2 continues to time t3, and the ink is ejected as a droplet from the nozzle 51 as schematically illustrated in FIG. 8E.

Subsequently, at time t3, the bias voltage V1 is applied as a cancel pulse. The ink pressure inside the pressure chamber 41 is lowered by ejecting ink. The vibration of the ink remains in the pressure chamber 41. In this regard, the actuator 8 is driven such that the voltage V2 is changed to the voltage V1 to contract the volume of the pressure chamber 41, and the inner ink pressure of the pressure chamber 41 is made substantially zero, thereby forcibly preventing the residual vibration of the ink in the pressure chamber 41.

Herein, the property of the pressure vibration transmitted to peripheral channels when the actuator 8 is driven is described based on the result of the test performed by using the ink jet head 1A in which 213 channels are arranged two-dimensionally in the nozzle plate 5. As described above, one channel is configured by one set of the nozzle 51 and the actuator 8. FIG. 9A illustrates channel numbers allocated to the 213 channels arranged in an XY direction. Naturally, the channels arranged in the Y-axis direction are obliquely arranged in practice as illustrated in FIG. 3. In the following, right and left (X-axis direction) sides, upper and lower (Y-axis direction) sides, and an oblique side are mentioned for convenience of explanation of the positional relation between the channels.

For example, when a channel 108 which is one of the 213 channels is given attention, and other channels are driven individually, the distribution diagram of FIG. 9B is obtained by plotting the magnitude of the pressure given to the attention channel 108. The channels are driven by giving a step waveform to the actuator 8. The step waveform is a waveform for measurement which contracts the actuator 8 only once as illustrated in FIG. 9C. A period after the contraction is set as a measurement period. The numerical value in each cell of the distribution diagram of FIG. 9B indicates the magnitude of the pressure generated in the attention channel 108 when ten seconds elapse after the drive signal is given to the driven channel. A positive value indicates a positive pressure, and a negative value indicates a negative pressure. A voltage value (mV) of the piezoelectric effect generated in the piezoelectric body 85 of the actuator 8 of the attention channel 108 is measured as the value indicating the magnitude of the pressure.

When illustrated in the distribution diagram of FIG. 9B, the channels surrounding the attention channel 108 generate pressure at almost the same phase as each other (the range of the positive value), and further the channels surrounding the outer periphery thereof reversely generate pressure at the almost reverse phases (the range of the negative value). That is, a distance from the attention channel 108 to the area of the channel which generates the reverse-phase pressure corresponds to a half wavelength of the pressure vibration which is transmitted while spreading along the surface of the nozzle plate 5. That is, the half wavelength of the pressure vibration which is transmitted while spreading along the surface of the nozzle plate 5 is longer than a pitch (adjacent distance) of the channels arranged in the nozzle plate 5 in a surface direction. For this reason, the pressure vibrations of the channels, which have a positional relation of being close to each other, such as adjacent channels are in phase.

The waveform diagram of FIG. 10 illustrates the respective pressure waveforms (residual vibration waveform) appearing in the attention channel 108 when a channel 116 and a channel 132 are driven individually. The channel 116 is next to the right side of the attention channel 108. The channel 132 is positioned at the third right position from the attention channel 108. In the pressure waveform (residual vibration waveform), a vertical axis indicates the voltage value (mV) of the piezoelectric effect representing the magnitude of the pressure, and a horizontal axis indicates time (μs). The natural pressure vibration period λ of the ink jet head 10A is 4 μs, and the half period (AL) thereof is 2 μs. From the result, it is understood that the pressure given to the attention channel varies in the magnitude and the phase depending on the places of the driven channels.

Figure 11:
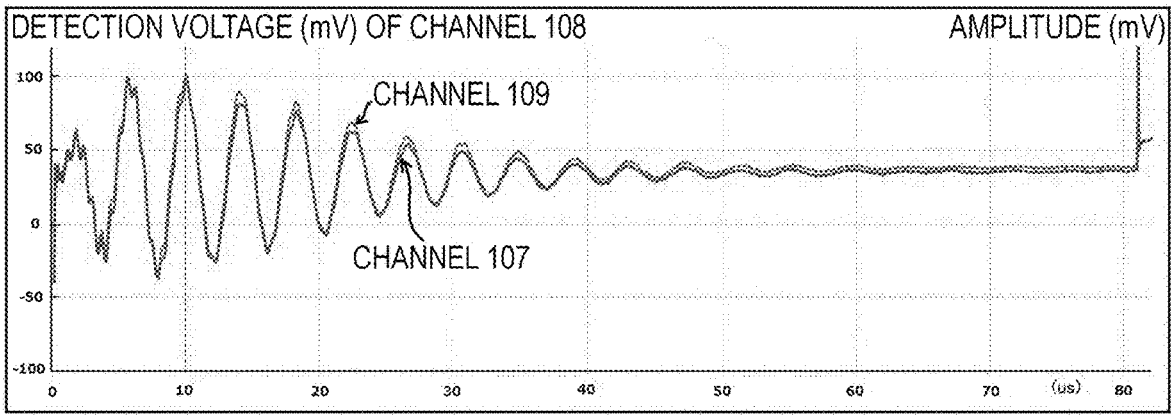
FIG. 11 is a graph illustrating pressure waveforms (residual vibration waveform) appearing in the attention channel 108 when a channel 109 and a channel 107 are driven individually.

On the other hand, the waveform diagram of FIG. 11 illustrates the respective pressure waveforms (residual vibration waveform) appearing in the attention channel 108 when a channel 109 and a channel 107 are driven individually. The channel 109 is next to the upper side of the attention channel 108. The channel 107 is next to the lower side of the attention channel. From the result, it is understood that the pressure waveforms which the channels next to the upper side and the lower side of the attention channel give to the attention channel are similar.

Figure 12:
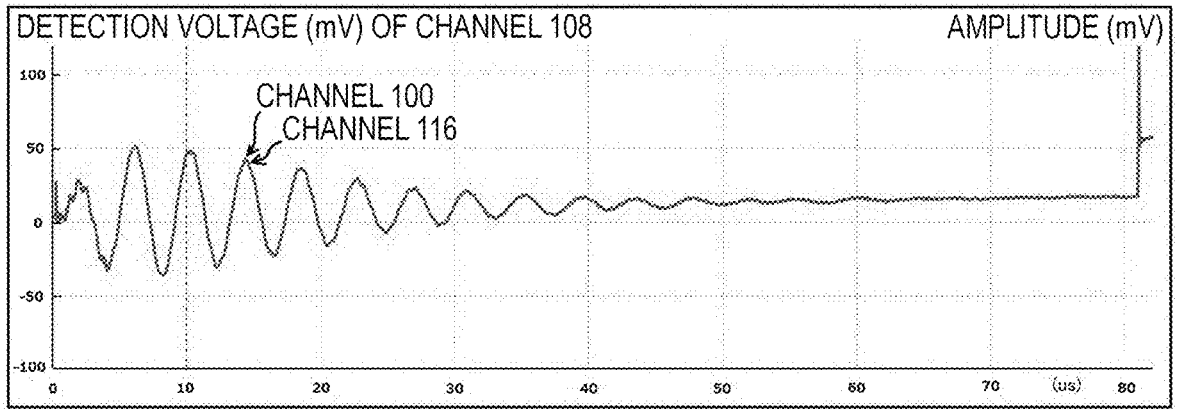
FIG. 12 is a graph illustrating pressure waveforms (residual vibration waveform) appearing in the attention channel 108 when a channel 100 and the channel 116 are driven individually.

The waveform diagram of FIG. 12 illustrates the respective pressure waveforms (residual vibration waveform) appearing in the attention channel 108 when a channel 100 and the channel 116 are driven individually. The channel 100 is next to the left side of the attention channel 108. The channel 116 is next to the right side of the attention channel 108. From the result, it is understood that the pressure waveforms which the channels next to the left side and the right side of the attention channel give to the attention channel 108 are almost identical.

Figure 13:
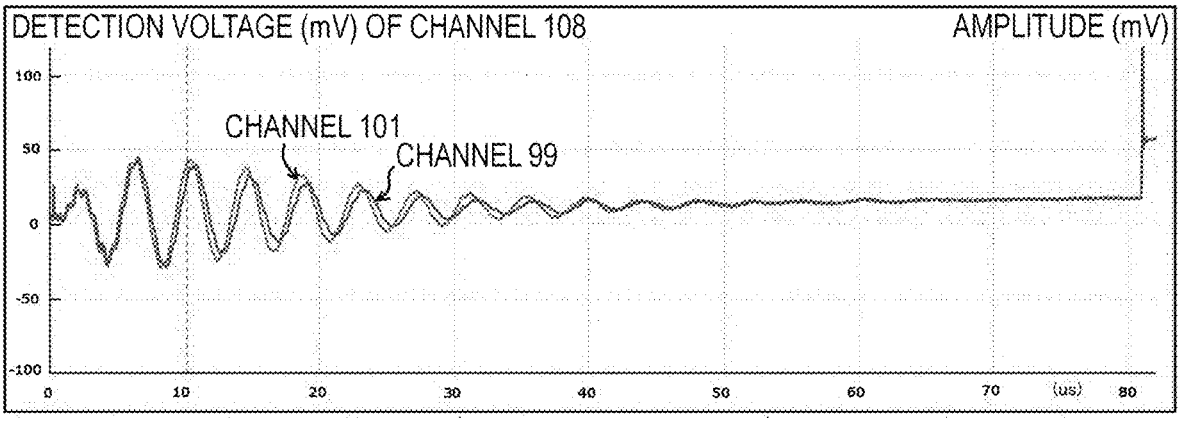
FIG. 13 is a graph illustrating pressure waveforms (residual vibration waveform) appearing in the attention channel 108 when a channel 101 and a channel 99 are driven individually.

The waveform diagram of FIG. 13 illustrates the respective pressure waveforms (residual vibration waveform) appearing in the attention channel 108 when a channel 101 and a channel 99 are driven individually. The channel 101 is next to the upper left side of the attention channel 108. The channel 99 is next to the lower left side of the attention channel 108. From the result, it is understood that the pressure waveforms which the channels next to the obliquely upper left side and the obliquely lower left side of the attention channel give to the attention channel are also similar.

Figure 14:
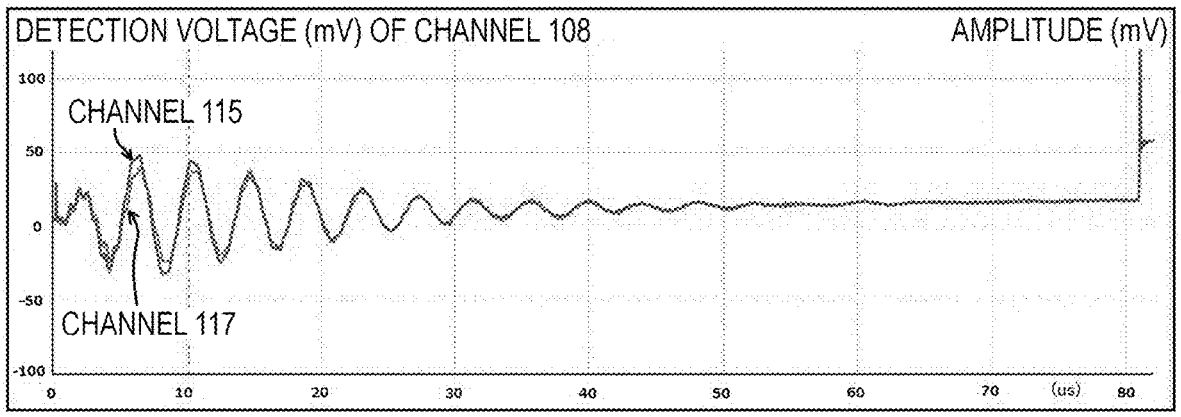
FIG. 14 is a graph illustrating pressure waveforms (residual vibration waveform) appearing in the attention channel 108 when a channel 117 and a channel 115 are driven individually.

The waveform diagram of FIG. 14 illustrates the respective pressure waveforms (residual vibration waveform) appearing in the attention channel 108 when a channel 117 and a channel 115 are driven individually. The channel 117 is next to the upper right side of the attention channel 108. The channel 115 is next to the lower right side of the attention channel 108. From the result, it is understood that the pressure waveforms which the channels next to the obliquely upper right side and the obliquely lower right side of the attention channel give to the attention channel are also similar.

From the results illustrated in FIGS. 9A to 14, it is understood that the channels which are positioned to be symmetrical to the attention channel give almost the same pressure vibration to the attention channel. That is, the channels adjacent to the right and left sides (X-axis direction) of the attention channel, the channels adjacent to the upper and lower sides (Y-axis direction) of the attention channel, and the channels adjacent to the obliquely upper and obliquely lower sides of the attention channel are each positioned to be symmetrical to the attention channel and each give almost the same pressure vibration to the attention channel.

Figure 15:
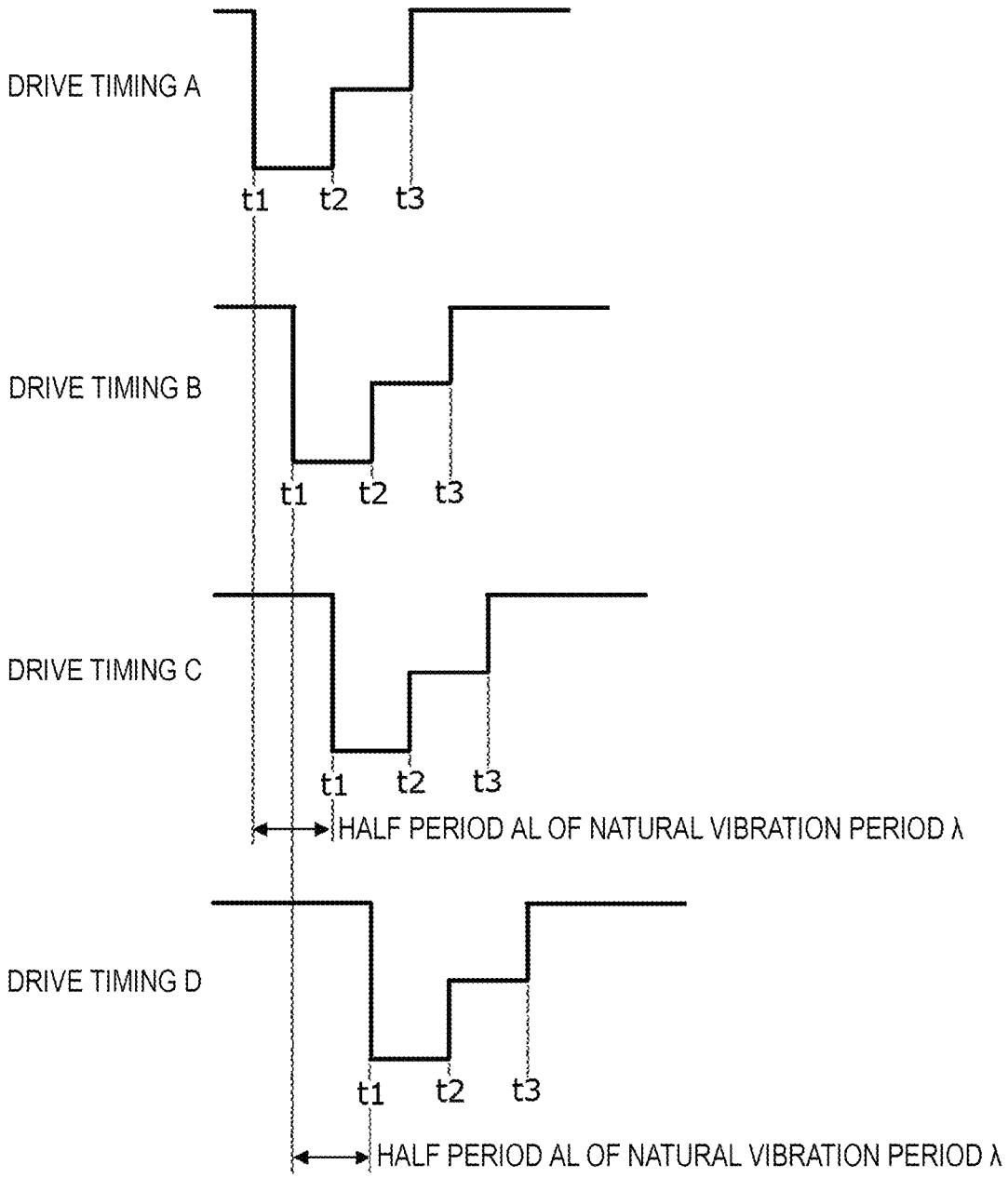
FIG. 15 is a view for explaining four drive timings A to D in which time differences (delay time) are set between drive waveforms for driving channels.

Based on the above results, four drive timings A to D in which time differences (delay time) are provided between the drive waveforms given to the plural actuators 8 are prepared as one example is illustrated in FIG. 15. The delay time of the drive waveform of the drive timing A and the drive waveform of the drive timing C becomes the half period AL (one half of λ) of the natural pressure vibration period λ. The delay time of the drive waveform of the drive timing B and the drive waveform of the drive timing D becomes the half period AL (one half of λ) of the natural pressure vibration period λ.

In the above-described delay time, the delay time of the drive waveform of the drive timing A and the drive waveform of the drive timing B becomes one-fourth period (one-fourth of λ) of the natural pressure vibration period λ. The delay time of the drive waveform of the drive timing A and the drive waveform of the drive timing D becomes three-quarter period (three quarters of λ) of the natural pressure vibration period λ. The delay time of the drive waveform of the drive timing B and the drive waveform of the drive timing C becomes one-fourth period (one-fourth of λ) of the natural pressure vibration period λ.

As one example is illustrated in FIG. 16A, the drive timings A to D are regularly allocated to all the channels. That is, in the channel to which the drive timing A is allocated, both right and left adjacent channels and both upper and lower adjacent channels thereof are combined with the drive timing B and the drive timing D, respectively. The upper left and lower left adjacent channels and the upper right and lower right adjacent channels are combined with the drive timing A and the drive timing C. In the channel to which the drive timing B is allocated, both right and left adjacent channels and both upper and lower adjacent channels are combined with the drive timing A and the drive timing C, respectively. The upper left and lower left adjacent channels and the upper right and lower right adjacent channels are combined with the drive timing B and the drive timing D. In the channel to which the drive timing C is allocated, both right and left adjacent channels and both upper and lower adjacent channels are combined with the drive timing B and the drive timing D, respectively. The upper left and lower left adjacent channels and the upper right and lower right adjacent channels are combined with the drive timing A and the drive timing C. In the channel to which the drive timing D is allocated, both right and left adjacent channels and both upper and lower adjacent channels are combined with the drive timing A and the drive timing C, respectively. The upper left and lower left adjacent channels and the upper right and lower right adjacent channels are combined with the drive timing B and the drive timing D. In the channel at a corner, naturally, the channels adjacent to one side of upper and lower sides and one side of the right and left sides become targets.

When the channel to which the drive timing A is allocated is given attention, the drive timings of both right and left adjacent channels are the drive timing B and the drive timing D, and thus the phases of the pressure vibrations from both right and left adjacent channels are shifted by the half period AL of the natural vibration period λ. The same is applied to both upper and lower adjacent channels. The upper left and lower left adjacent channels are the drive timing A and the drive timing C, and thus the phases of the pressure vibrations from the upper left and lower left adjacent channels are shifted by the half period AL of the natural vibration period λ. The same is applied to the upper right and lower right adjacent channels.

When the channel to which the drive timing B is allocated is given attention, the drive timings of both right and left adjacent channels are the drive timing A and the drive timing C, and thus the phases of the pressure vibrations from both right and left adjacent channels are shifted by the half period AL of the natural vibration period λ. The same is applied to both upper and lower adjacent channels. The upper left and lower left adjacent channels are the drive timing B and the drive timing D, and thus the phases of the pressure vibrations from the upper left and lower left adjacent channels are shifted by the half period AL of the natural vibration period λ. The same is applied to the upper right and lower right adjacent channels.

When the channel to which the drive timing C is allocated is given attention, the drive timings of both right and left adjacent channels are the drive timing B and the drive timing D, and thus the phases of the pressure vibrations from both right and left adjacent channels are shifted by the half period AL of the natural vibration period λ. The same is applied to both upper and lower adjacent channels. The upper left and lower left adjacent channels are the drive timing A and the drive timing C, and thus the phases of the pressure vibrations from the upper left and lower left adjacent channels are shifted by the half period AL of the natural vibration period λ. The same is applied to the upper right and lower right adjacent channels.

When the channel to which the drive timing D is allocated is given attention, the drive timings of both right and left adjacent channels are the drive timing A and the drive timing C, and thus the phases of the pressure vibrations from both right and left adjacent channels are shifted by the half period AL of the natural vibration period λ. The same is applied to both upper and lower adjacent channels. The upper left and lower left adjacent channels are the drive timing B and the drive timing D, and thus the phases of the pressure vibrations from the upper left and lower left adjacent channels are shifted by the half period AL of the natural vibration period λ. The same is applied to the upper right and lower right adjacent channels.

As described above, 4 μs is used as the natural pressure vibration period λ of the ink jet head 1A, and the half period AL is 2 μs. Accordingly, the drive timing of each the channel is expressed by the delay amount as illustrated in FIG. 16B. Numerical values 0, 1, 2, and 3 in the cells correspond to the drive timings A, B, C, and D, respectively. Since the drive timing A is set as a reference (=0), the drive timings B, C, and D are expressed by the delay amounts of 1 μs, 2 μs, and 3 μs from the drive timing A, respectively. Although any shifted channel is given attention, in the peripheral channels thereof, both right and left adjacent channels, both upper and lower adjacent channels, the upper left and lower left adjacent channels, and the upper right and lower right adjacent channels are each driven at the drive timings shifted by 2 μs from each other.

Figure 17:
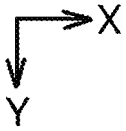
FIG. 17 is a matrix illustrating a distribution of delay amounts including "shift times" allocated to all the channels.

As one more preferable example, a "shift time" for avoiding the power concentration during the simultaneous operation of the actuator 8, particularly, at the time of operating the actuators 8 of each group of the drive timings A to D at the same timing is added to the delay amount (μs) of each channel. The delay amount (μs) illustrated in FIG. 17 is obtained by further adding the shift time of 0.02 μs to the delay amount (μs) illustrated in FIG. 16B. The drawing is illustrated in two stages for convenience. A detailed explanation about how to add the shift time will be provided below in detail.

That is, although any channels are given attention, in the 213 channels to which the above-described drive timings A to D are allocated, the channels adjacent in the right and left direction and the channels adjacent the upper and lower direction are each driven at the drive waveforms with phases reverse to each other. As described above, the channels adjacent in the right and left direction and the upper and lower direction are channels which are positioned to be symmetrical to the attention channel. The channels which are positioned symmetrically give the pressure vibration with almost the same or similar waveforms to the attention channel. Therefore, when both channels are driven at the same timing (in-phase), the vibrations are added to each other to amplify the pressure vibration, which is given to the attention channel. However, when the drive timings are shifted by the half period, and the channels are driven in the drive waveforms with reverse phases, the pressure vibrations with the reverse phases in which the vibrations are canceled by each other are given to the attention channel. As a result, the peripheral channels hardly have an effect at the time of driving the plurality of channels, and thus it is possible to stably eject ink.

FIGS. 16 and 17 are respective examples of the drive timings A to D and the delay amounts (μs) which are allocated to the 213 channels. However, even if the number of the channels is 213 or more, a stable ejection can be performed when the drive timings A to D and the delay amounts (μs) is allocated with the same regularity.

Figure 18:
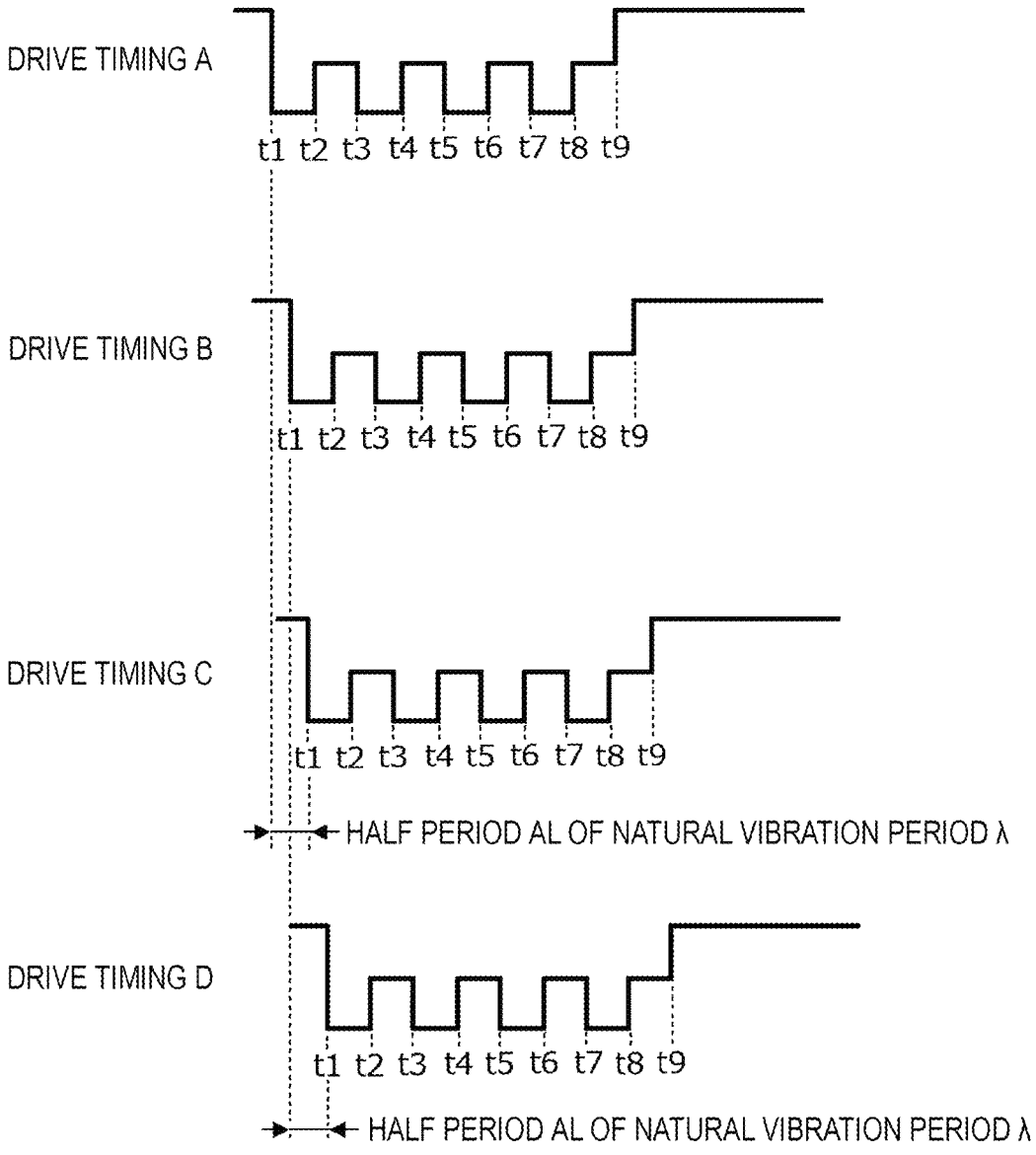
FIG. 18 is a view for explaining another example of the drive waveforms for driving the channels.

The drive waveform may be a multi-drop waveform which ejects a plurality of small drops while forming one dot. The drive waveform illustrated in FIG. 18 is one example of the multi-drop waveform which ejects four small drops while forming one dot. The ejections of the small drops are performed at times t2, t4, t6, and t8 with the timing when the voltage V2 is given to the actuator 8 as a starting point. The time from time t1 to time t2, the time from time t2 to time t3, the time from time t3 to time t4, the time from time t4 to time t5, the time from time t5 to time t6, the time from time t6 to time t7, the time from time t7 to time t8, and the time from time t8 to time t9 are each set to the half period (AL) of the natural vibration period λ. FIG. 18 illustrates four drive timings A to D when time differences (delay time) are provided between the drive waveforms. The drive timing C is delayed by the half period (AL) from the drive timing A. The drive timing D is delayed by the half period (AL) from the drive timing B. Therefore, the drive timing A and the drive timing C of the multi-drop waveform are driven at the reverse phases whenever small drops are ejected. The drive timing B and the drive timing D of the multi-drop waveform are driven at the reverse phases whenever small drops are ejected. For this reason, in the multi-drop waveform, the pressure propagation is canceled more effectively.

Figure 19:
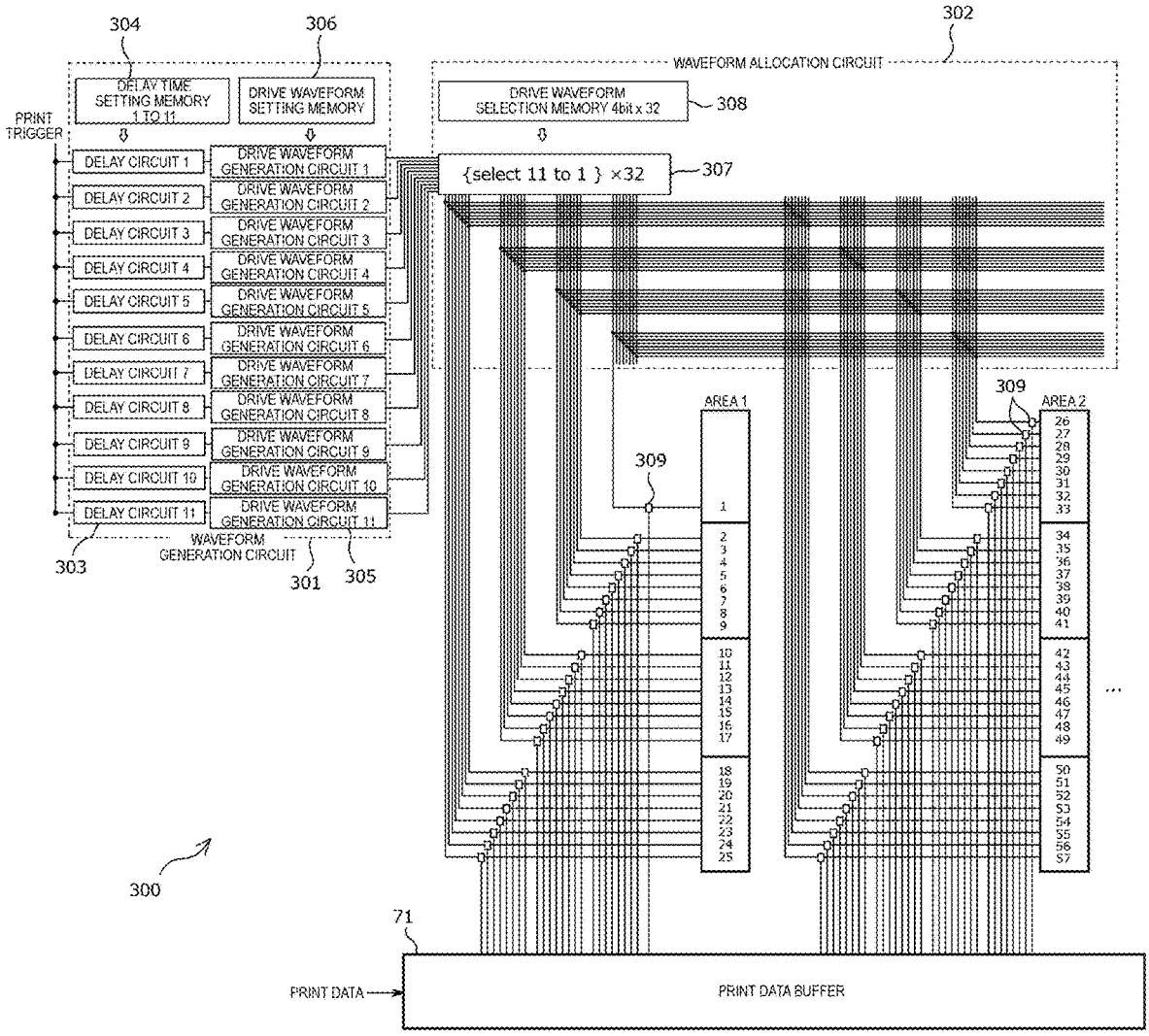
FIG. 19 is a configuration diagram of the drive circuit which gives a drive signal to each channel.

Subsequently, one example of a specific circuit configuration of a drive circuit 300 which gives plural kinds of drive signals having different drive timings to the actuators 8 will be described with reference to FIGS. 19 to 21. For example, the drive circuit 300 illustrated in FIG. 19 is included in the drive circuit 7 illustrated in FIGS. 2 and 6. The drive circuit 300 illustrated in FIG. 19 has a circuit configuration which can set the drive timing among the drive timings A to D and the channel to be allocated and starts to generate the drive waveform at the allocated drive timings A to D. In the following description, a case where the channels are each driven according to the drive waveform of FIG. 7 and the delay amounts (μs) including the shift time of FIG. 17 will be described as one example. Naturally, the circuit configuration can be applied in another drive waveform and another drive timing.

As illustrated in FIG. 19, the drive circuit 300 includes a waveform generation circuit 301 and a waveform allocation circuit 302. The waveform generation circuit 301 includes a plurality of delay circuits 303, a delay time setting memory 304, a plurality of drive waveform generation circuits 305, and a drive waveform setting memory 306. The plurality of delay circuits 303 are connected with the plurality of drive waveform generation circuits 305 in series, respectively. The pairs of the delay circuits 303 and the drive waveform generation circuits 305 are set as eleven pairs, for example.

The setting values of plural kinds of the delay amount (μs) are stored in the delay time setting memory 304. FIG. 20 illustrates one example of the setting values of the delay amounts (μs) stored in the delay time setting memory 304. The setting values of the delay amounts (μs) have eleven kinds of delay from delay 1 to delay 11. The setting values of eleven kinds of delay amounts (μs) are determined by allocating 0.02 μs as a "shift time" to the delay amounts (0 μs, 1 μs, 2 μs, 3 μs) of the drive timings A, B, C, and D with the drive timing A as a reference. Specifically, in delay 1 to delay 11, the delay amounts (0 μs, 1 μs, 2 μs, 3 μs) are repeatedly arranged in order of the drive timings A, B, C, and D, and the "shift time" of 0.02 μs is further added in order of delay 1 to delay 11. The shift time is not limited to 0.02 μs. The delay amounts (μs) of delay 1 to delay 11 can be changed. In some cases, the half period (AL) of the natural vibration period λ is changed by ink. Thus, the delay amount (μs) is set from a firmware of the inkjet printer 10, for example. Otherwise, the delay amount may be set while the ink jet head 1A is manufactured, for example.

The drive waveform illustrated in FIG. 7 is stored in the drive waveform setting memory 306. However, the kind of the drive waveform stored in the drive waveform setting memory 306 is not limited to one. Plural kinds of the drive waveforms including the multi-drop drive waveform illustrated in FIG. 18 or the like may be stored, and any drive waveform may be selected among. The same drive waveform may be selected for all the drive waveform generation circuits 305, and different drive waveforms may be selected for each drive waveform generation circuit 305.

The waveform allocation circuit 302 includes a selector 307 and a drive waveform selection memory 308. The drive waveform selection memory 308 stores an "allocation pattern" which sets the channel and the delay amount or the drive timings A to D to be allocated in a predetermined array. FIG. 21 illustrates one example of the allocation pattern. The allocation pattern illustrated in FIG. 21 defines the pattern in which eleven kinds of delay 1 to delay 11 are allocated in a matrix of four columns and eight rows. Specifically, when the delays 1 to 8 are allocated in the first column, the delays 2 to 9 shifted upward by one row are allocated in the second column, and the delays 3 to 10 further shifted upward by one row are allocated in the third column. Similarly, the delays 4 to 11 are allocated also in the fourth column.

The array of the allocation pattern is not limited to four columns and eight rows and may be a matrix of four columns and four rows. That is, the array of the allocation pattern can set in a range of M columns and N rows (M and N are integers). However, when the channels two-dimensionally arranged in the XY direction are expressed in X columns and Y rows, and the magnitude of the range of M columns and N rows satisfies $M<X$, and $N\leq Y$, for example.

The selector 307 is a "11 to 1" selector of 32 channels (ch), for example. The selector 307 is connected with the output end of each drive waveform generation circuit 305. The output ends of 32ch of the selector 307 are connected with the channels through switches 309, respectively. In the 213 channels, when eight channels are set as one set, one area is configured by four sets of channel groups (a total of 32 channels). Although the illustration is omitted for convenience, seven areas are provided totally. For example, a plurality of channels shares the same channel (ch) in seven areas, such that the channel 1 of the area 1 and the channel 33 of the area 2 are the same channel (ch).

The switch 309 performs switching control on whether or not the drive signal from the selector 307 is given to the channel. The detail of the switch 309 is anyone of the circuit configuration of FIGS. 23 to 27 to be illustrated below. The switch 309 performs an on-off operation according to the signal of a print data buffer 71. The print data buffer 71 includes the drive circuit 7 of FIG. 6. In the circuit configuration of FIG. 19, the circuit, which includes the switch 309, from the selector 307 to each channel configures a drive signal output circuit which gives the drive signal of the drive waveform to the actuator 8 according to each drive timing.

In the above-described drive circuit 300, when a print trigger is given to the delay circuits 303, the delay circuits 303 activate the drive waveform generation circuits 305 after the delay times (0.02 μs to 3.16 μs) elapse, respectively. The drive waveform generation circuits 305 output the drive waveforms stored in the drive waveform setting memory 306, respectively. Accordingly, generation start timings of the drive waveforms are shifted by the delay amounts (μs) set in delays 1 to 11.

Eleven kinds of drive waveforms from respective drive waveform generation circuits 305 are given to the selector 307. As illustrated in FIG. 22, the selector 307 distributes eleven kinds of drive waveforms with different generation start timings to the channels of eight rows and four columns by an allocation pattern P stored in the drive waveform selection memory 308. When the allocation pattern P is shifted in the +X direction to be applied repeatedly, eleven kinds of drive waveforms with different generation start timings are allocated to all the channels arranged two-dimensionally. In this case, the drive waveform of the fifth column is the same as that of the first column. The sixth column and the second column have the same drive waveform, and the seventh column and the third column have the same drive waveform. As described above, when the allocation pattern P is repeatedly applied, any one of eleven kinds of drive waveforms with different generation start timings can be set in all the 213 channels. FIG. 17 illustrates the drive waveforms by specific delay amounts (μs).

The drive signals of the drive waveforms allocated by the selector 307 are given to the switches 309, respectively. When the switch 309 is turned on, the drive signal is given to the actuator 8 of the channel. Conversely, when the switch 309 is turned off, the drive signal is not given to the actuator 8 of the channel. It is the print data that determines whether the switch 309 is turned on or off. The switch 309 of each channel is turned on or off based on the print data transferred from the image memory 94 of FIG. 6 through a serial interface to the print data buffer 71, for example. That is, it is controlled whether the ink is ejected from the nozzle 51 of each channel.

As illustrated in FIG. 3, 22, or the like, the nozzle 51 is arranged in Y rows and X columns on the surface. For example, when the sheet S as a recording medium approaches from the −Y direction, the channels belonging to different rows necessarily have different timings. However, the shift of the timing between the rows is compensated, for example, when the print data is rearranged by the control board 17 (see FIG. 6) including the CPU 90 which is a control part of the inkjet printer 10.

As described above, according to the ink jet head 1A of the liquid ejection device 1 of the embodiment, eleven kinds of drive waveforms having different generation start timings are generated in the waveform generation circuit 301, and the generated drive waveforms are allocated to the channels by the waveform allocation circuit 302. When the actuators 8 of the channels are driven according to the allocated drive waveforms, the crosstalk in which the operations of the actuators 8 interfere with each other can be suppressed, and liquid can be ejected stably.

Particularly, when the drive timings A to D or the delay amount (μs) is allocated as illustrated in FIG. 16A, 16B, or 17, a multi-nozzle ink jet head can be achieved in which the crosstalks applied to the attention channel can be canceled by each other due to the above-described reason.

The current peak of the time of giving the drive waveform to the actuator 8 can be dispersed by applying a minute "shift time". The actuator 8 including the piezoelectric body 85 is a capacitive load. When the voltage is applied to the capacitive load, a rush current flows. However, when the voltage is applied to many actuators 8 simultaneously, the current peaks are concentrated to cause the decrease of the power supply voltage, generate an electromagnetic wave, or cause a malfunction. The above-described minute shift of 0.02 μs is a time sufficient to prevent the concentration of the current peak by minutely shifting the timing of applying the voltage to the capacitive load in the channels, and the decrease of the power supply voltage, the generation of the electromagnetic wave, and the malfunction can be prevented. On the other hand, since the minute shift of 0.02 μs is sufficiently short time compared to the pressure vibration period, the adverse effect on the shift of the ink ejection timing is reduced.

In the above-described embodiment, the setting values of the delay amounts (μs) of eight rows and four columns (=a total of 32 positions) can be selected and set by the drive waveform selection memory 308. However, the drive waveform is selected among eleven kinds of drive waveforms. If the drive waveform selection memory 308 is not used, thirty-two drive waveform generation circuits 305 are necessarily provided. However, the kinds of the drive waveform are narrowed to eleven kinds by using the drive waveform selection memory 308, so as to reduce a circuit scale.

In the above-described embodiment, the allocation pattern P of the delay amounts (μs) is arranged in eight rows and four columns, and the allocation pattern P is repeatedly applied in the X direction. If the allocation pattern is not repeatedly applied, and a circuit configuration is formed in which every channel includes the drive waveform selection memory 308, the degree of freedom in setting is increased, but the circuit scale is increased. That is, in the above-described embodiment, a predetermined array of the allocation pattern P is set, and the allocation pattern P is applied repeatedly, thereby reducing the circuit scale.

Figure 24:
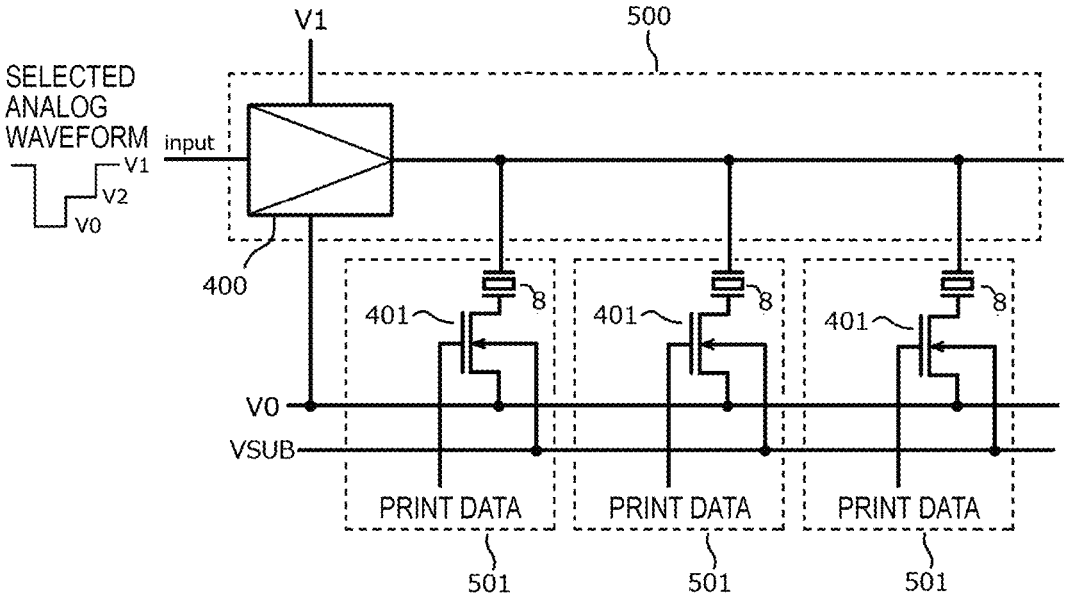
FIG. 24 is still another configuration example of the drive circuit which gives the drive signal to each channel.

Subsequently, the switch 309 will be described in detail with reference to FIGS. 23 to 27. As described above, any one of the circuit configuration of FIGS. 23 to 27 is the detail of the switch 309. If the drive waveform generation circuits 305 output respective analog waveforms, the selector 307 is an analog signal selector of 32 channels (ch). That is, the selector 307 selects and outputs an analog signal. In this case, as illustrated in FIG. 23, the switch 309 of FIG. 19 has a circuit configuration in which an amplifier circuit 400 is provided which amplifies the analog signal, and an on-off control is performed on the amplifier output from the amplifier circuit 400 based on the print data. For example, an on-off switching is performed by a transistor 401. As illustrated in FIG. 24, the circuit which performs the on-off control on the amplifier output from the amplifier circuit 400 may control another terminal of the actuator 8. In this case, a negative power is applied to a VSUB. In FIGS. 23 and 24, a circuit 500 surrounded by a dotted line is the portion which are shared by the channels (ch) to which the same delay amount (μs) is allocated, and a circuit 501 surrounded by a dotted line is the portion independent from all the channels (ch). The same is also applied to FIG. 25.

Figure 25:
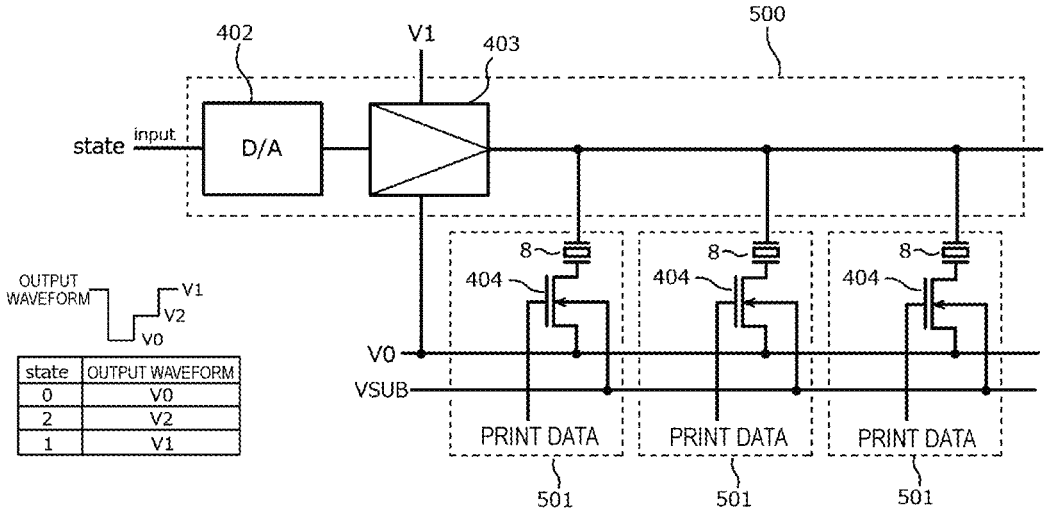
FIG. 25 is still another configuration example of the drive circuit which gives the drive signal to each channel.

If the drive waveform generation circuits 305 output respective coded digital waveforms, the selector 307 is a digital signal selector of 32 channels (ch). In FIG. 25, the coded digital waveform in which states 0, 2, and 1 correspond to the voltages V0, V2, and V1 is illustrated exemplarily. If the coded digital waveform is multi-bit, the digital signal selector of 32 channels (ch) is a selector of plural-bit width per channel. If the selector 307 selects and outputs a digital signal as described above, as illustrated in FIG. 25, the switch 309 has a circuit configuration in which a digital-to-analog (D/A) converter 402 and an amplifier circuit 403 which amplifies the D/A conversion result are provided, and the on-off control is performed on the amplifier output from the amplifier circuit 403 based on the print data. For example, the on-off switching is performed by a transistor 404.

Instead of the circuit configuration in which the digital signal from the selector 307 is D/A-converted to be amplified by the amplifier circuit 403, the output transistor which turns on or off a predetermined voltage directly by the digital signal or through a decoder may be controlled to charge or discharge the actuator 8. In the circuit configuration, the coded digital waveform selected by the selector 307 is decoded to control the output transistor and outputs the drive waveform for ejection if the print data is valid. In this case, the output transistor can be considered to be both an amplifier and a D/A conversion function.

As illustrated in FIG. 26A, a circuit configuration which includes a glitch removal/dead time generation circuit 405 can be adopted as one example. In the case of the circuit configuration, the selector 307 selects and outputs the coded digital signal illustrated in FIG. 26B-1 or FIG. 26B-2 and gives a0 to a2 to respective inverters of FIG. 26D according to the correspondence relation of FIG. 26C to turn on or off transistors (Q1, Q2p, Q2n, and Q0). The glitch removal/dead time generation circuit 405 removes a glitch noise generated in decoding of a decoder 406 and delays the transition of the off-state to the on-state without delaying the transition of the on-state to the off-state so as to prevent that the transistors (Q1, Q2p, Q2n, and Q0) connected with a plurality of different power supplies are simultaneously turned on instantaneously when the transistors (Q1, Q2p, Q2n, and Q0) to be turned on are changed.

Figure 27:
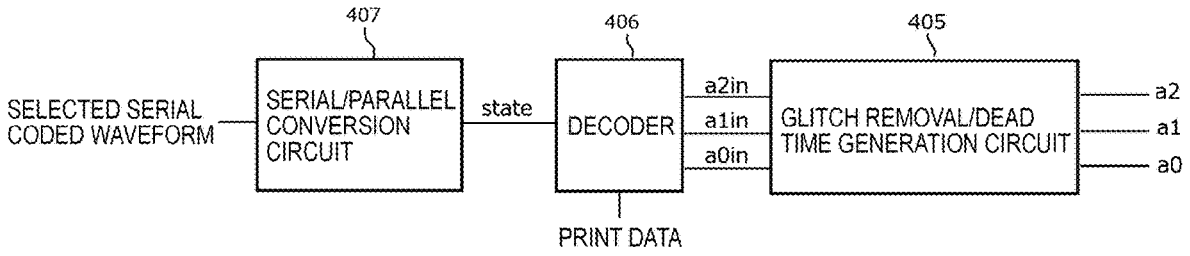
FIG. 27 is still another configuration example of the drive circuit which gives the drive signal to each channel.

If the coded digital waveform is a 1-bit serial code, in the digital signal selector of 32 channels (ch), each channel may have a 1-bit width. In this case, as illustrated in FIG. 27, a serial/parallel conversion circuit 407 is further added to the circuit configuration of FIG. 26A. The selected serial coded waveform is converted in parallel and then decoded to control the output transistors (Q1, Q2p, Q2n, and Q0).

As described above, various variations may be made about a portion to be analog-processed and a portion to be digital-processed in the drive circuit 300. Any selection can be made according to the design, for example.

In the above-described embodiment, the setting of the delay time and the allocation of the drive waveform to each channel can be set by writing setting values in the delay time setting memory 304 and the drive waveform selection memory 308. However, the setting value may be set to a fixed value. In this case, the degree of freedom of setting change in the different actuators 8 or the different inks is lost. However, the circuit scale can be reduced largely.

Figure 28:
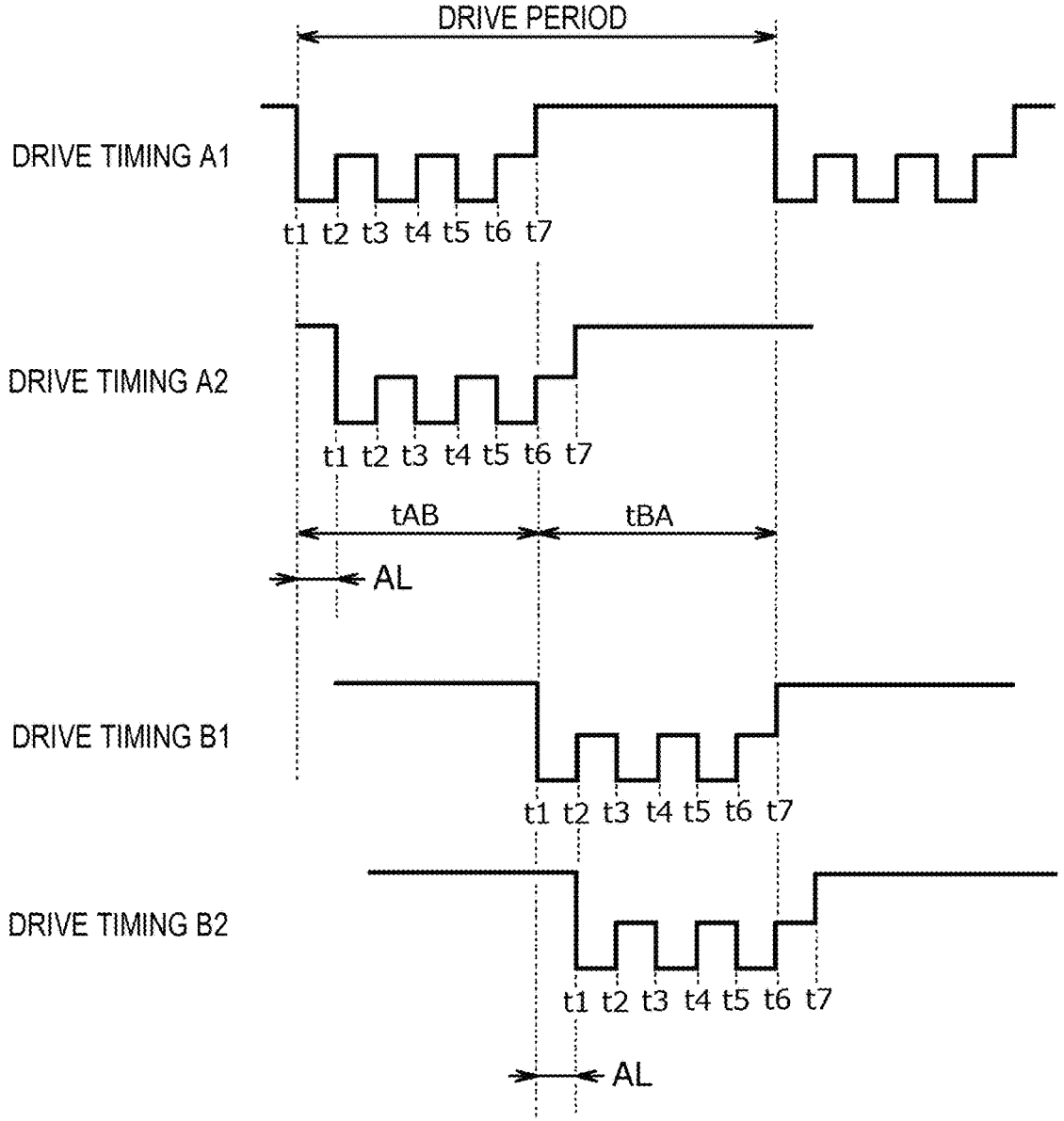
FIG. 28 is a view for explaining four drive timings A1, A2, B1, and B2 in which time differences (delay time) are set between the drive waveforms for driving the channels.
Figures 29, 30:
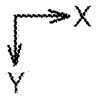
FIG. 29 is a matrix in which the drive timings A1, A2, B1, and B2 are regularly allocated to all the channels and which illustrates a distribution of the delay times of respective channels.
FIG. 30 is a view for explaining setting values of delay amounts stored in the delay time setting memory.

As another example of the drive waveform and the drive timing, the drive timings A1, A2, B1, and B2 may be set in the multi-drop drive waveform illustrated in FIG. 28 as illustrated in the same drawing, and the drive timings A1, A2, B1, and B2 may be allocated to have a checkered pattern illustrated in FIG. 29.

The drive waveform of a group A configured by the drive timings A1 and A2 and the drive waveform of a group B configured by the drive timings B1 and B2 are shifted to each other by a half of the drive period. One drive period is configured by time tAB of performing the ejection operation of a former half portion and time tBA of the standby until the next ejection operation is started. As one example, if each pulse of the drive waveform from time t1 to time t7 is set to the half period AL of the natural vibration period λ, and the drive period of the ink jet head 1A is 24 μs, the time tAB of the ejection operation is 12 μs. Preferably, the time tAB of the ejection operation and the time tBA of the standby are the same time or almost the same time.

Even in the drive waveforms of the group A, the drive waveform of the drive timing A1 and the drive waveform of the drive timing A2 are shifted by the half period AL (a half of λ) of the natural pressure vibration period λ. Similarly, even in the drive waveforms of the group B, the drive waveform of the drive timing B1 and the drive waveform of the drive timing B2 are shifted by the half period AL (a half of λ) of the natural pressure vibration period λ. However, the drive waveforms may have phases reverse to each other, and the shifted time (delay time) is not limited to the half period (1AL). The shifted time may be odd times the half period AL.

As in the checkered pattern illustrated in FIG. 29, the drive timings A1, A2, B1, and B2 are regularly allocated to all the 213 channels. That is, the drive timing (B1 or B2) of the group B is allocated to all the channels adjacent to the upper and lower sides and the right and left sides of the channel to which the drive timing (A1 or A2) of the group A is allocated. Conversely, the drive timing (A1 or A2) of the group A is allocated to all the channels adjacent to the upper and lower sides and the right and left sides of the channel to which the drive timing (B1 or B2) of the group B is allocated. In the channel at a corner, naturally, the channels adjacent to one side of upper and lower sides and one side of the right and left sides become targets.

In the channels adjacent to the upper and lower sides of the channel to which the drive timing (A1 or A2) of the group A is allocated, the drive timing B1 is allocated to one channel, and the drive timing B2 is allocated to the other channel. In the channels adjacent to the right and left sides, the drive timing B1 is allocated to one side, and the drive timing B2 is allocated to the other side. That is, the channels adjacent to the upper and lower sides and the channels adjacent to the right and left sides each are a pair of channels which are driven by the drive waveforms with reverse phases.

Similarly, in the channels adjacent to the upper and lower side of the channel to which the drive timing (B1 or B2) of the group B is allocated, the drive timing A1 is allocated to one channel, and the drive timing A2 is allocated to the other channel. In the channels adjacent to the right and left sides, the drive timing A1 is allocated to one channel, and the drive timing A2 is allocated to the other channel. That is, the channels adjacent to the upper and lower sides and the channels adjacent to the right and left sides each are a pair of channels which are driven by the drive waveforms with reverse phases.

FIG. 30 illustrates one example of the setting value of the delay amount (μs) stored in the delay time setting memory 304 if the drive timings A1, A2, B1, and B2 are allocated as illustrated in FIG. 29. That is, FIG. 30 is one example of the setting value of the delay amount (μs) when the time tAB of the ejection operation is set to 12 μs. The delay amount is determined by allocating the "shift time" of 0.02 μs to each of the delays 1 to 11.

Even in the case of the setting value of the delay amount (μs) of FIG. 30, in the above-described drive circuit 300, when the print trigger is given to the delay circuits 303, the delay circuits 303 activate the drive waveform generation circuits 305 after the delay times elapse, respectively. The drive waveform generation circuits 305 output the drive waveforms stored in the drive waveform setting memory 306, respectively.

Eleven kinds of drive waveforms from the drive waveform generation circuits 305 are given to the selector 307. As illustrated in FIG. 22, the selector 307 distributes eleven kinds of drive waveforms with different generation start timings to the channels of eight rows and four columns by the allocation pattern P stored in the drive waveform selection memory 308. When the allocation pattern P is shifted in the +X direction to be applied repeatedly, eleven kinds of drive waveforms with different generation start timings are allocated to all the channels arranged two-dimensionally.

The drive signals of the drive waveforms allocated by the selector 307 are given to the switches 309, respectively. When the switch 309 is turned on, the drive signal is given to the actuator 8 of the channel.

That is, in the 213 channels illustrated as one example in FIG. 29, even when any channel is given attention, the drive period between the channels adjacent to the upper and lower sides of the channel and the drive period between the channels adjacent to the right and left sides of the channel are shifted by a half. If the drive period is short, the printing speed is fast. The drive period is determined from the printing speed required for a printer. When the drive period is a predetermined value, tAB is set to be equal to tBA, such that any channel is driven at the timing separated as far as possible from the drive timings of the channels adjacent to the upper and lower sides and the right and left sides. Accordingly, it is possible to reduce the crosstalk from the channels which are adjacent to the upper and lower sides and the right and left sides and to which the channel is most susceptible. As one example is illustrated in FIG. 30, the current peak when the drive waveform is given to the actuator 8 can be dispersed by adding a minute "shift time" to the delay time.

Second Embodiment

Figure 31:
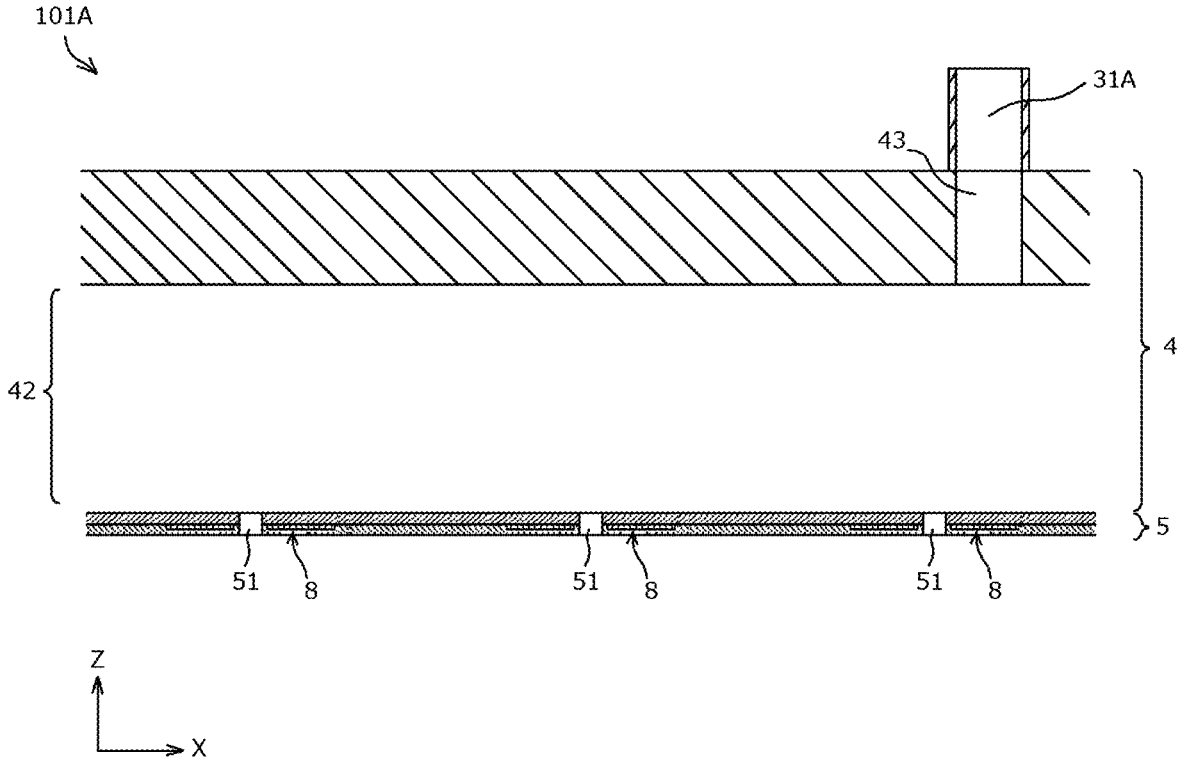
FIG. 31 is a longitudinal sectional view of an ink jet head of one example of a liquid ejection device of a second embodiment.

Subsequently, a liquid ejection device of a second embodiment will be described. FIG. 31 illustrates a longitudinal sectional view of an ink jet head 101A as one example of the liquid ejection device. The ink jet head 101A is configured to be the same as the inkjet head 1A illustrated in the first embodiment except that the pressure chamber (individual pressure chamber) 41 is not provided, and the nozzle plate 5 communicates directly with the common ink chamber 42. Accordingly, the same configurations as those in FIG. 4 are denoted by the same reference numerals, and the detail description is not given.

The ink jet head 101A illustrated in FIG. 31 is also driven with the drive waveforms having different generation start timings allocated to all the channels. Even in this case, the multi-nozzle ink jet head can be achieved in which the crosstalks applied to the attention channel can be canceled by each other due to the above-described reason.

That is, in the ink jet heads 1A and 101A, the actuator 8 and the nozzle 51 are arranged on the surface of the nozzle plate 5. In this case, when the plurality of actuators 8 are driven simultaneously, the surface of the nozzle plate 5 is bent, and the crosstalk in which the operation of the actuator 8 interferes with the operation of another actuator 8 occurs due to the reason that the pressure change from the peripheral actuators 8 has an effect through the common ink chamber 42. In this regard, when the drive waveforms with the different generation start timings are allocated as described above, the crosstalks from the peripheral actuators 8 is prevented.

In the above-described embodiment, the ink jet heads 1A and 101A of the inkjet printer 1 are described as one example of the liquid ejection device. However, the liquid ejection device may be a shaping-material ejection head of a 3D printer and a sample ejection head of a dispensing device.

As described above, a liquid ejection device of the embodiment includes:

a nozzle plate in which a plurality of nozzles for ejecting liquid are arranged;

an actuator provided in each of the nozzles;

a liquid supply unit configured to communicate with the nozzles;

a waveform generation circuit which generates plural kinds of drive waveforms with different generation start timings;

a waveform allocation circuit capable of setting a drive waveform among the plural kinds of drive waveforms and an actuator of a nozzle to be allocated; and a drive signal output circuit which drives the actuators with the respective allocated drive waveforms.

The waveform allocation circuit is capable of setting an allocation pattern of the drive waveform for a nozzle with a predetermined array and includes a circuit in which the allocation pattern is applied repeatedly to allocate the drive waveforms to the plurality of nozzles.

The plurality of nozzles are arranged two-dimensionally in X columns and Y rows, the predetermined array is a two-dimensional array with M columns and N rows, and it is satisfied that $M<X$ and $N\leq Y$.

The number of plural kinds of drive waveforms with different generation start timings is smaller than a product ($=M\times N$) of the M and the N.

A multi-nozzle liquid ejection device of the embodiment includes:

a nozzle plate in which a plurality of nozzles for ejecting liquid are arranged two-dimensionally in an XY direction;

an actuator provided in each of the nozzles;

a liquid supply unit configured to communicate with the nozzles; and a plurality of drive signal output circuits which, when any nozzle among the plurality of nozzles is given attention, drive actuators such that a drive timing of the actuator of the nozzle is different from a drive timing of an actuator of a nozzle adjacent in an X direction and is different from a drive timing of an actuator of a nozzle adjacent in a Y direction.

The drive timings which the plurality of drive signal output circuits give to the actuators of the plurality of nozzles are repeated for each area having a two-dimensional array of M columns and N rows ($M<X$, $N\leq Y$).

A multi-nozzle liquid ejection device of the embodiment includes:

a nozzle plate in which a plurality of nozzles for ejecting liquid are arranged two-dimensionally in an XY direction;

an actuator provided in each of the nozzles;

a liquid supply unit configured to communicate with the nozzles; and a plurality of drive signal output circuits which drive actuators of a nozzle adjacent in a +X direction and a nozzle adjacent in a −X direction with different drive timings and drive actuators of a nozzle adjacent in a +Y direction and a nozzle adjacent in a −Y direction with different drive timings.

The drive timings which the plurality of drive signal output circuits give to the actuators of the plurality of nozzles are repeated for each area having a two-dimensional array of M columns and N rows ($M<X$, $N\leq Y$).

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A liquid ejection device, comprising:

a nozzle plate in which a plurality of nozzles for ejecting liquid are arranged, wherein each of the nozzles is provided with an actuator such that one set of the nozzle and the actuator configure one channel;

a liquid supply unit configured to communicate with the nozzles;

a waveform generation circuit configured to generate plural kinds of drive waveforms with different generation start timings, the generation start timings being shifted by a delay amount;

a waveform allocation circuit configured to set a drive waveform among the plural kinds of drive waveforms and an actuator of a nozzle to be allocated; and a drive signal output circuit configured to drive the actuators with the respective allocated drive waveforms, characterized in that:

the waveform allocation circuit includes a drive waveform selection memory that stores an allocation pattern of the drive waveform which sets the channel and a delay amount among a plurality of values of delay amount to be allocated in a predetermined array; and the waveform allocation circuit is further configured to set the allocation pattern of the drive waveform for the channel with the predetermined array.

2. The device according to claim 1, wherein the waveform allocation circuit includes a circuit in which the allocation pattern is applied repeatedly to allocate the drive waveforms to the plurality of nozzles.

3. The device according to claim 2, wherein the plurality of nozzles are arranged two-dimensionally in X columns and Y rows, the predetermined array is a two-dimensional array with M columns and N rows, where $M<X$ and $N\leq Y$.

4. The device according to claim 1, wherein each actuator comprises two electrodes and a piezoelectric element.

5. The device according to claim 1, wherein the drive waveform comprises at least one of a pulling striking waveform, a pushing striking waveform, and a pushing and pulling striking waveform.

6. The device according to claim 1, wherein the drive waveform comprises at least one of a single pulse waveform, a double pulse waveform, and a triple pulse waveform.

7. The device according to claim 1, wherein the different generation start timings are an acoustic length apart from each other.

8. The device according to claim 1, wherein a plurality of nozzles for ejecting liquid are arranged two-dimensionally in an XY direction in the nozzle plate, and the device further comprises a plurality of drive signal output circuits configured to, when any nozzle among the plurality of nozzles is given attention, drive actuators such that a drive timing of an actuator of a first nozzle is different from a drive timing of an actuator of a second nozzle adjacent the first nozzle in an X direction and is different from a drive timing of an actuator of a third nozzle adjacent the first nozzle in a Y direction.

9. The device according to claim 8, wherein the waveform allocation circuit includes a circuit in which the allocation pattern is applied repeatedly to allocate the drive waveforms to the plurality of nozzles.

10. The device according to claim 9, wherein the plurality of nozzles are arranged two-dimensionally in X columns and Y rows, the predetermined array is a two-dimensional array with M columns and N rows, where $M<X$ and $N\leq Y$.

11. The device according to claim 8, wherein each actuator comprises two electrodes and a piezoelectric element.

12. The device according to claim 8, wherein the drive waveform comprises at least one of a pulling striking waveform, a pushing striking waveform, and a pushing and pulling striking waveform.

13. The device according to claim 8, wherein the drive waveform comprises at least one of a single pulse waveform, a double pulse waveform, and a triple pulse waveform.

14. The device according to claim 8, wherein the different generation start timings are an acoustic length apart from each other.

15. The device according to claim 1, wherein a plurality of nozzles for ejecting liquid are arranged two-dimensionally in an XY direction in the nozzle plate and the device further comprises a plurality of drive signal output circuits configured to drive actuators of a second nozzle adjacent a first nozzle in a +X direction and a third nozzle adjacent the first nozzle in a −X direction with different drive timings and drive actuators of a fourth nozzle adjacent the first nozzle in a +Y direction and a fifth nozzle adjacent the first nozzle in a −Y direction with different drive timings.

16. The device according to claim 15, wherein the plurality of nozzles are arranged two-dimensionally in X columns and Y rows, a predetermined array is a two-dimensional array with M columns and N rows, where $M<X$ and $N\leq Y$.

17. The device according to claim 15, wherein each actuator comprises two electrodes and a piezoelectric element.

18. The device according to claim 15, wherein the drive waveform comprises at least one of a pulling striking waveform, a pushing striking waveform, and a pushing and pulling striking waveform.

19. The device according to claim 15, wherein the drive waveform comprises at least one of a single pulse waveform, a double pulse waveform, and a triple pulse waveform.

20. The device according to claim 15, wherein the different generation start timings are an acoustic length apart from each other.

* * * * *